US009694502B2

(12) United States Patent
Pesikov

(10) Patent No.: US 9,694,502 B2
(45) Date of Patent: Jul. 4, 2017

(54) INCORPORATING SHAVING AID ELEMENTS ON A RAZOR CARTRIDGE

(75) Inventor: Vitaly Pesikov, Canton, MA (US)

(73) Assignee: The Gillette Company, Boston, MA (US)

( * ) Notice: Subject to any disclaimer, the term of this patent is extended or adjusted under 35 U.S.C. 154(b) by 563 days.

(21) Appl. No.: 12/913,019

(22) Filed: Oct. 27, 2010

(65) Prior Publication Data

US 2012/0102741 A1 May 3, 2012

(51) Int. Cl.
*B26B 21/44* (2006.01)

(52) U.S. Cl.
CPC ..... *B26B 21/44* (2013.01)

(58) Field of Classification Search
CPC ..... B26B 21/44; B26B 21/443; B26B 21/446; B26B 21/222; B26B 19/40; A61Q 9/02
USPC ..... 30/537, 538, 41
See application file for complete search history.

(56) References Cited

U.S. PATENT DOCUMENTS

| | | | | |
|---|---|---|---|---|
| 4,683,096 | A * | 7/1987 | Ferraro | 264/249 |
| 4,697,342 | A * | 10/1987 | Ferraro | 30/41 |
| 5,369,885 | A * | 12/1994 | Ferraro | 30/41 |
| 5,551,153 | A * | 9/1996 | Simms | 30/41 |
| 5,915,791 | A * | 6/1999 | Yin et al. | 30/41 |
| 6,568,084 | B2 * | 5/2003 | McCool et al. | 30/50 |
| 6,996,908 | B2 | 2/2006 | Orloff et al. | |
| 7,172,069 | B2 | 2/2007 | Coffin et al. | |
| 7,266,895 | B2 * | 9/2007 | Pennella et al. | 30/531 |
| 7,703,361 | B2 | 4/2010 | Johnson et al. | |
| 8,726,519 | B2 * | 5/2014 | Clarke et al. | 30/41 |
| 2003/0167644 | A1 * | 9/2003 | Motta et al. | 30/526 |
| 2003/0209457 | A1 | 11/2003 | Coffin et al. | |
| 2005/0015990 | A1 | 1/2005 | Barone et al. | |
| 2005/0166403 | A1 | 8/2005 | Orloff et al. | |
| 2006/0080837 | A1 | 4/2006 | Johnson et al. | |

OTHER PUBLICATIONS

PCT International Search Report with Written Opinion in corresponding Int'l appln. PCT/US2011/057610 dated Jan. 30, 2012.

* cited by examiner

*Primary Examiner* — Jennifer Swinney
(74) *Attorney, Agent, or Firm* — Joanne N. Pappas; Kevin C. Johnson; Steven W. Miller

(57) ABSTRACT

As provided in the present invention, a shaving aid element includes a novel shaving aid holder having one or more "undercut elements" incorporated on its upper surface. These undercut elements provide an interlocking mechanism to retain a shaving aid portion to the shaving aid holder. The interlocking mechanism of the undercut element comprises an interlock area of the shaving aid portion and an interlock area of the shaving aid holder. The undercut elements include one or more protrusions or cavities, in the upper surface of the shaving aid holder, and may be curved hook-like structures or mushroom shaped structures, straight-line structures, or angled structures, in any combination. The shaving aid portion, as not being disposed on a lower surface of the shaving aid holder, provides utility for disposing at least one aesthetic element (e.g., indicia), at least one functional element (e.g., exfoliation) or any combination thereof.

24 Claims, 20 Drawing Sheets

INCORPORATING SHAVING AID ELEMENTS ON A RAZOR CARTRIDGE

FIELD OF THE INVENTION

This invention relates to razor blades, and more particularly to razor blade cartridge formation.

BACKGROUND OF THE INVENTION

Modern shaving systems incorporate soap elements in the design of the shaving cartridge, oftentimes referred to as a 2-in-1 type razor cartridge since there is no initial lathering step (e.g., no need for shave gel/cream, soap, or body wash). Examples of 2-in-1 razor cartridges are readily found in the marketplace in female razor systems, for instance, the Gillette® Venus® Breeze™ razor or the Schick® Intuition® and Intuition Plus® razor products.

In the case of the Schick Intuition razor cartridge, there is a soap ring disposed around the periphery of the cartridge. In the case of the Gillette Venus Breeze razor cartridge, there are two shaving aid elements, generally comprising a shaving aid holder having a shaving aid material or composition (e.g., a shaving aid portion) disposed thereon, the latter for instance being in the form of gel bars or soap elements. These shaving aid portions are formed by over-molding onto shaving aid holders, the latter oftentimes referred to as "wings." The attachment of the shaving aid portion to each wing is typically accomplished by embedding the wing within the bulk of soap.

Such wing type cartridges, for instance, are described in detail in U.S. Pat. No. 7,703,361, entitled Shaving Razors and Cartridges, assigned to the Assignee hereof. Referring to FIGS. 1, 1A, 2, 2A, and 3A-3C, a prior art razor cartridge 10 on handle 11 is shown having shaving aid portions 12*a* and 12*b* which are carried on a pair of wings 14*a* and 14*b* (shown in FIGS. 3A-3C). There, the wings 14*a*, 14*b* themselves may be formed of the same plastic as the razor cartridge frame 15 such as a molded plastic, or may be formed of a different material. For instance, the wings may be formed of the same material as hinges 16*a*, 16*b* that join the wings and frame in which case the wings and hinges may be over-molded onto the frame in a single molding step.

These wings in the shaving aid holder generally necessarily include a plurality of apertures 17 as shown in FIGS. 3B and 3C used for allowing the shaving aid composition to flow through the thickness of the wing and to form a mechanical interlock (e.g., by flowing together to form a unitary mass) on the back side of the wing, so as to secure the shaving aid portion to the wing. In this manner, shaving aid composition is disposed on both sides of the wing as shown in FIG. 2A.

With shaving aid portion on the back side of the wing, a major disadvantage of cartridges as arranged in the prior art is that any amount of the shaving aid material or composition on the back side of the wing may likely be wasted. This is because the portion of the shaving aid portions 12*a* and 12*b* found on the back side of the cartridge, opposite the skin, necessarily deployed on the back side of the wings 14*a* and 14*b* to secure the portions 12*a* and 12*b* to the wings as shown in FIGS. 2 and 2A, is generally never used. Where shaving aid material is a costly component of this type of razor cartridge, this may generally not be desirable.

Furthermore, these structures (for the "wings" or other plastic mechanisms) used for shaving aid holders often do not provide adequate clasping mechanisms for holding the shaving aid composition in place in repeated wet shaving environments and many times the shaving aid composition is let go from the holder or falls off while the effectiveness of the cartridge is still viable.

SUMMARY OF THE INVENTION

The invention provides a razor cartridge including a shaving aid holder with one or more undercut elements. In one aspect, the one or more undercut elements are incorporated onto an upper surface of the shaving aid holder. The one or more undercut elements further include one or more protrusions protruding from the upper surface of said shaving aid holder, one or more cavities recessed in the upper surface of the shaving aid holder, or any combination thereof. In another aspect of the present invention, the one or more undercut elements further comprise a curved hook-like structure or mushroom shape structure, a straight-line structure, an angled structure, or any combination thereof. The razor cartridge further includes at least one shaving aid portion disposed onto an upper surface of the at least one shaving aid holder covering the one or more undercut elements.

In a main aspect of the present invention, the one or more undercut elements provide an interlocking mechanism for retaining the at least one shaving aid portion to the at least one shaving aid holder, wherein the interlocking mechanism further includes an interlock area of the shaving aid portion and an interlock area of the shaving aid holder. The one or more undercut elements are rigid, flexible, semi-rigid, or any combination thereof and are comprised of plastic, metal, a composite, or any combination thereof. At least one of the undercut elements has a curved upper surface, which desirably curves towards an upper surface of said shaving aid holder.

The one or more undercut elements have a height or depth ranging from about 0.2 mm to about 2.5 mm. The at least one shaving aid portion may be comprised of poured, pressed, or extruded soap, gel, lubricant, moisturizer, or any combination thereof where the shaving aid holder is comprised of a polymeric material, an elastomeric material, or any combination thereof. Also the shaving aid holder may be formed as a wing, a ring, a part of a frame or housing, cap, guard, clip, or mount structure coupled to the razor cartridge, or any combination thereof.

In a further aspect of the present invention, the at least one shaving aid holder has no apertures. In another aspect, the at least one shaving aid holder has one or more apertures.

In one embodiment of the present invention, the shaving aid portion is not disposed on a lower surface of the shaving aid holder. Furthermore, at least one aesthetic element, at least one functional element, or any combination thereof may be disposed on the lower surface of the at least one shaving aid holder. The at least one aesthetic element further includes indicia, marking, design, graphic, text, or any combination thereof. The at least one functional element further includes exfoliation, skin conditioning, moisturization elements, or any combination thereof.

In another embodiment of the present invention, at least one shaving aid holder has one or more undercut elements incorporated onto an upper surface of the at least one shaving aid holder and at least one shaving aid portion is disposed on the upper surface of the at least one shaving aid holder covering the one or more undercut elements. In a main aspect of the present invention, one or more undercut elements provide an interlocking mechanism for retaining the at least one shaving aid portion to the at least one shaving aid holder. The interlocking mechanism includes an interlock area of the at least one shaving aid portion and an interlock area of the at least one shaving aid holder.

In a method of manufacturing a razor cartridge, steps include incorporating one or more undercut elements onto an upper surface of at least one shaving aid holder and injecting at least one shaving aid portion onto the upper surface of at least one shaving aid holder covering the one or more undercut elements. In one aspect of the present invention, the at least one shaving aid portion is fluid, liquid, semi-solid, or any combination thereof and is injected through a gate in the at least one shaving aid holder. The gate may be self-closing or not observable to a consumer.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
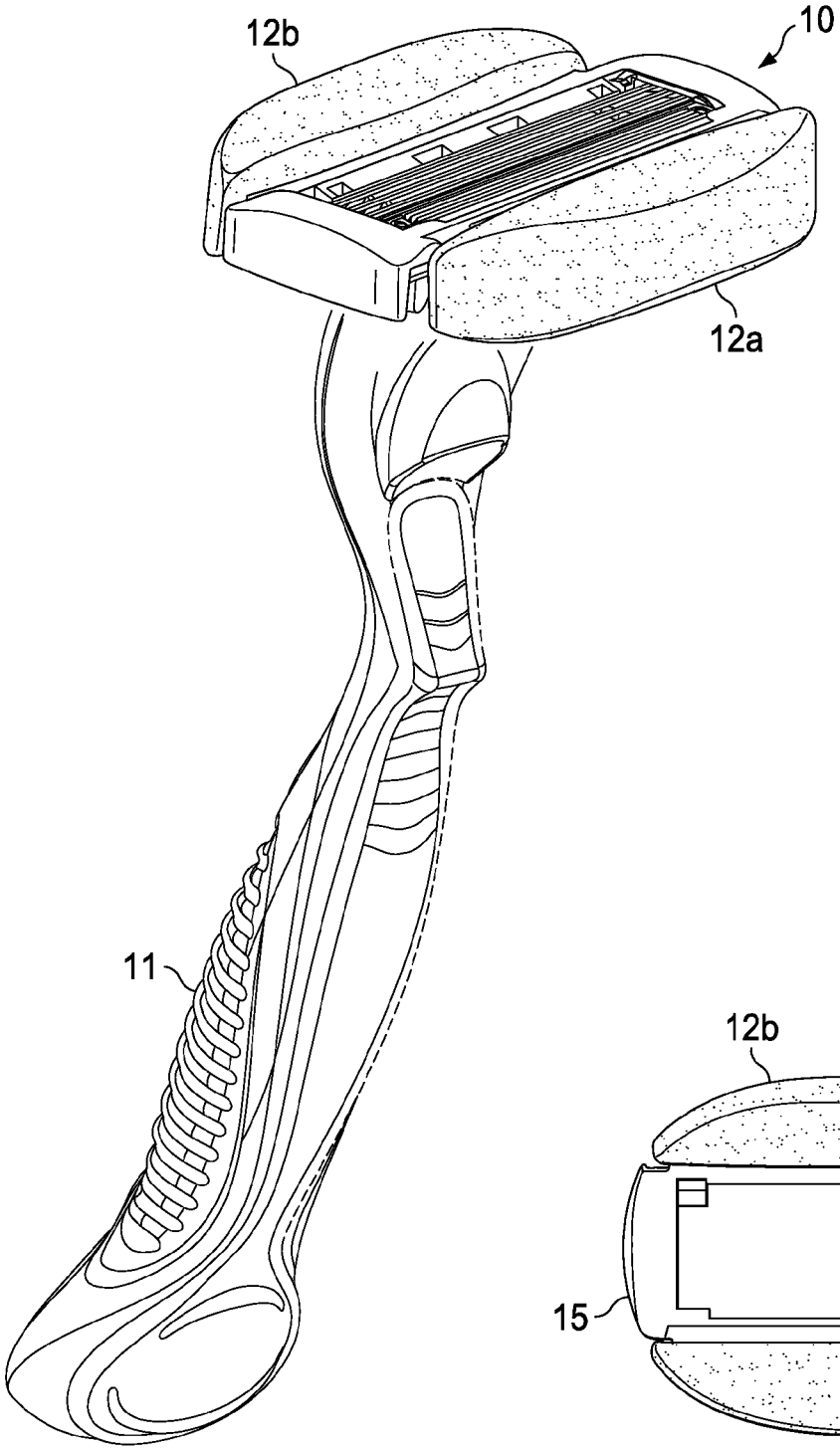
FIG. 1 (PRIOR ART)
FIGS. 1 and 1A are a perspective view of a prior art razor cartridge having two shaving aid portions.

The invention discloses a novel apparatus and method of forming one or more shaving aid elements in a razor cartridge having one or more shaving aid portions disposed on at least one shaving aid holder with incorporated undercut elements.

The following defined terms are germane to the present invention and will be described in more detail with regard to the figures below.

In the present invention, the term "shaving aid element" signifies a shaving aid holder coupled with a shaving aid portion. A "shaving aid holder" refers to any apparatus for holding one or more shaving aid portions. Oftentimes, the shaving aid holder is referred to as a wing or a ring, for holding a shaving aid portion which generally extends from the razor cartridge. Shaving aid holders may generally be comprised of a polymeric material, such as polypropylene. Thus they may be comprised of hard or rigid plastic, but may also be made of elastomeric material. For instance, in some embodiments, the elastomeric portions may also be provided at the corners of the shaving aid holder (e.g., wings), underlying the shaving aid portions, so that as the shaving aid portions are exhausted, the user's skin will contact elastomer rather than hard plastic. Preferably, any elastomeric content of the shaving aid holder is relatively soft for user comfort but with sufficient chemical resistance so that it will not degrade during prolonged contact with the ingredients of the shaving aid portion. The shaving aid holder of the present invention may be relatively straight or have some curvature, the latter allowing the holders to carry a relatively large amount of shaving aid portion or soap, without the upper surface of the shaving aid portion extending too far above the plane of the blade edges or the lowest area of the shaving aid portion being too low to ever contact the skin during use.

In addition to being a wing or ring, the shaving aid holder of the present invention may also be formed as part of any component or structure of the cartridge. For instance, the shaving aid holder may be formed as a part of the plastic frame or housing, cap, guard, clip, or a part of the plastic mount coupled with the blade unit.

The upper surface of the shaving aid holder may be smooth, textured, rough, or any combination thereof.

The term "shaving aid portion", also germane to the present invention, is intended to include any formulation, material or composition (these latter terms may be used interchangeably). In some instances, the one or more shaving aid portions may generally include gel or soap, e.g., poured, pressed, or extruded soap, or any other feasible materials. Shaving aid portions of the present invention may generally include shave preparation ingredients such as lubricants, or skin soothing and conditioning ingredients such as emollients and moisturizers. These compositions may be modified to increase their hardness, wear resistance, lubricity and/or skin moisturizing and conditioning properties. The present invention contemplates any feasible desired formulation may be used to provide these skin care/skin improvement and/or enhanced shaving benefits.

Preferably, as with the prior art, the one or more shaving aid portions have sufficient wear resistance so that the one or more shaving aid portions last for the intended life of the cartridge. However, a shaving aid holder may be of a type which may be removable and replaceable by the consumer where for instance, the one or more shaving aid portions may be exhausted before it is necessary to replace the cartridge.

A novel aspect of the shaving aid holder of the present invention is that it desirably includes one or more "undercut elements". The undercut elements provide a mechanical fastening or interlocking mechanism that retains the shaving aid portion to the shaving aid holder. In the present invention, the undercut elements are incorporated onto an upper surface of the shaving aid holder.

The term "undercut" or "undercut element" as used in the present invention, signifies a feature having a shape, which when utilized in the practice of molding a part (e.g., injection molding a plastic part), results in some interference with the mold (e.g., shape of part will not allow it to readily separate or fall free); for instance, upon the opening or removal of the mold after formation of the part. The undercut element is generally formed of the same material as the shaving aid holder but generally may be formed of plastic, metal, a composite of any materials (e.g., plastic with metal, wood with plastic), or any combination thereof. In some instances, the present invention contemplates that a composite may desirably offer additional reinforcement for an undercut element.

The one or more undercut elements of the present invention may comprise a curved hook-like structure or mushroom shape structure, a straight-line structure, an angled structure, or any combination thereof.

To form such a feature on a part with an injection molding tool, the tool may generally have to reach under a portion of the element itself. As the molding tool opens in the vertical direction, the part being molded will not be able to freely separate as that undercut portion of the molding tool will prevent this motion.

Generally, such undercut elements are formed with the aid of "pulls" which typically signify elements of the mold that can be inserted and then pulled out of the way, allowing the undercut element to eject from the mold. Other methods include applying force to pry the part (e.g., the shaving aid holder formed with undercut elements) out of the mold. This necessitates the undercut feature (e.g., hook-like structure) to straighten out and flex its way out of the mold. Typically, all rubber-like or other plastic materials will permit flexing but when using more rigid materials such as polypropylene, it may be beneficial to decrease rupturing while removing the part when it is still warm and pliable in the mold.

Desirably, in the present invention, the undercut elements may range in height (or depth if recessed) from about 0.2 mm to about 2.5 mm and more desirably from about 0.4 mm to about 1.6 mm. Generally, the undercut elements of the present invention comprise aptly shaped structures that desirably form the undercut areas or "interlock areas" which provide interference with the mold as described above. One interlock area is provided by the shaving aid portion ("interlock area of the shaving aid portion") and the other is the interlock area provided by the shaving aid holder ("interlock area of the shaving aid holder"). When placed together, these two interlock areas provide a mechanical interlock of the shaving aid portion to the shaving aid holder.

Figure 4:
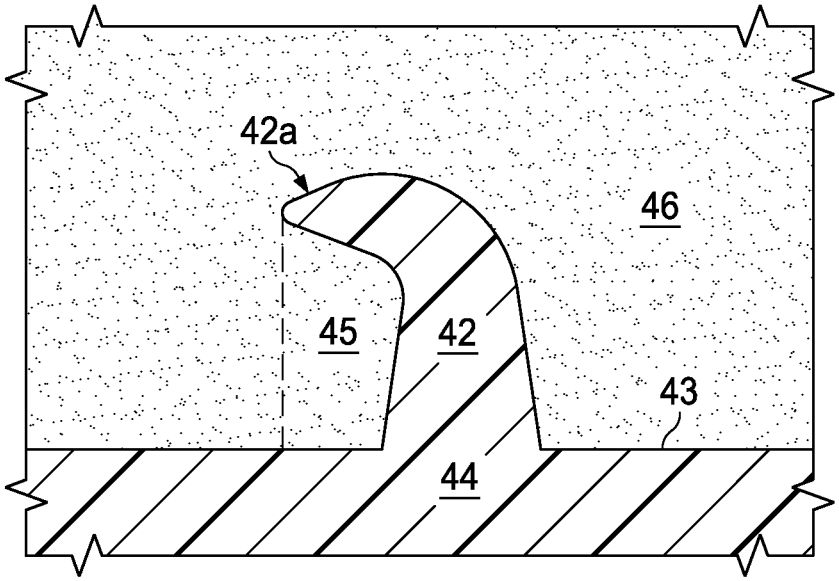
FIG. 4 and FIG. 5 depict two types of undercut elements in accordance with the present invention.
Figure 5:
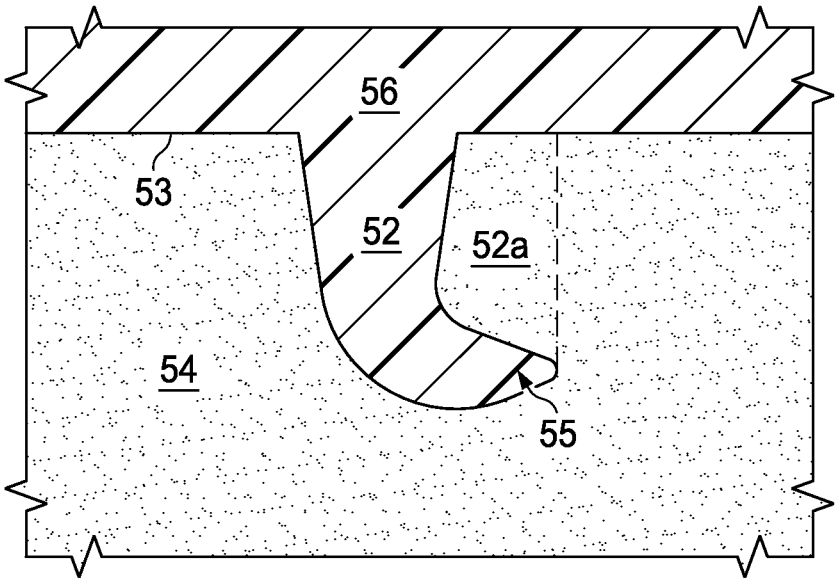

For instance, as shown in FIGS. 4 and 5, two exemplary undercut element types are depicted in accordance with the present invention. In FIG. 4, for simplicity, one undercut element 42 is shown having a hook-like, curved structure which characterizes the interlock area 42*a* of the shaving aid holder desirably formed of the same material as the shaving aid holder. The interlock area of the shaving aid holder 42*a* desirably is juxtaposed with an interlock area 45 of the shaving aid portion. The interlock area 45 of the shaving aid portion is desirably formed of the same material as the shaving aid portion. For instance, after pouring, shaving aid portion (e.g., in liquid form initially) may desirably fill the interlock area 45 and later solidify as the shaving aid portion changes from a liquid state to a solid state. It should be noted that the undercut element 42 of the present invention is not limited to the shape shown in FIG. 4 (or the shape of undercut element 52 shown in FIG. 5), but may be any desired and feasible shape, many of which will be shown and described in more detail below.

Undercut element 42 is desirably incorporated onto an outer surface 43 of a substrate 44 such as a plastic substrate. In one embodiment, undercut element 42 desirably protrudes from an outer surface 43 of substrate 44, such as a shaving aid holder.

Thus, in a razor cartridge, one or more undercut elements 42 may desirably be incorporated on an outer surface 43 of a shaving aid holder 44, as protrusions, protruding therefrom. Additionally, a shaving aid portion 46 may also desirably be disposed on a portion of the outer surface 43 of the shaving aid holder 44 as shown in FIG. 4 substantially covering undercut elements 42. Shaving aid portion 46 may generally initially be in a fluid, liquid, or semi-solid state, subsequently becoming solid or hardened. As the shaving aid portion 46 is formed onto the holder 44 it may desirably be poured or injected into the shaving aid holder 44 and before portion 46 solidifies or becomes hard, the shaving aid portion will flow into, over and around undercut element 42 and will thus flow and fill in the interlock area 45 of the shaving aid portion (e.g., under the hook-like structure of the interlock area 42*a* of the shaving aid holder). Once the shaving aid portion has hardened, one or more undercut elements 42 serve to lock the shaving aid portion 46 onto the shaving aid holder 44, providing a mechanical interlock such that the shaving aid portion 46 is retained and does not easily detach from shaving aid holder 44. In this instance, the hook-like structure of the interlock area 42*a* of the shaving aid holder of undercut element 42 may desirably be molded or formed from a portion of the shaving aid holder (e.g., plastic) whereas the interlock area 45 it provides is generally filled with a portion of the shaving aid portion 46.

In a similar, but alternate embodiment of the present invention shown in FIG. 5, a substrate 54 is shown having an upper surface 53 in which an exemplary undercut element 52 is disposed as a cavity, void, or recess in the upper surface of the shaving aid holder 54 defined by a hook-like or curved shaped structure (e.g., initially hollow), namely the interlock area of the shaving aid holder, or interlock area 52*a*, forming an interlock area of shaving aid portion 55. The interlock area 52*a* of undercut element 52 may desirably be provided via the shaving aid holder 54 in that it is molded or formed from a portion of the shaving aid holder 54 (e.g., plastic) and the hook-like interlock area 55 of undercut element 52 may generally be filled with a portion of the shaving aid portion 56 which later may desirably solidify. In a razor cartridge, undercut element 52, having an interlock area 52*a* of the shaving aid holder and an interlock area 55 of the shaving aid portion filled with shaving aid portion 56, provides the interlocking mechanism for the shaving aid portion with the shaving aid holder.

It can be seen that the same interlocking affect occurs in this embodiment as in the embodiment of FIG. 4, in that the undercut element 52's interlock areas provide an interlocking mechanism to retain the shaving aid portion to the shaving aid holder.

Thus, there is no necessity in the present invention for over-molding the shaving aid portion as in prior art designs described above where encompassing the outer lower side (or the opposite side) of the shaving aid holder with the shaving aid portion itself to retain the shaving aid portion to the shaving aid holder was generally obligatory.

There is also therefore no requirement or necessity for glues or other adhesives to retain the shaving aid portion to the wings or within the shaving aid holder. While generally not necessary, the present invention does contemplate coating or other surface modifications including texturizing, notching or roughening of the outer surface of the shaving aid holder and/or of the outer surface of the undercut element (not shown) which may provide additional adhesion.

Figure 6:
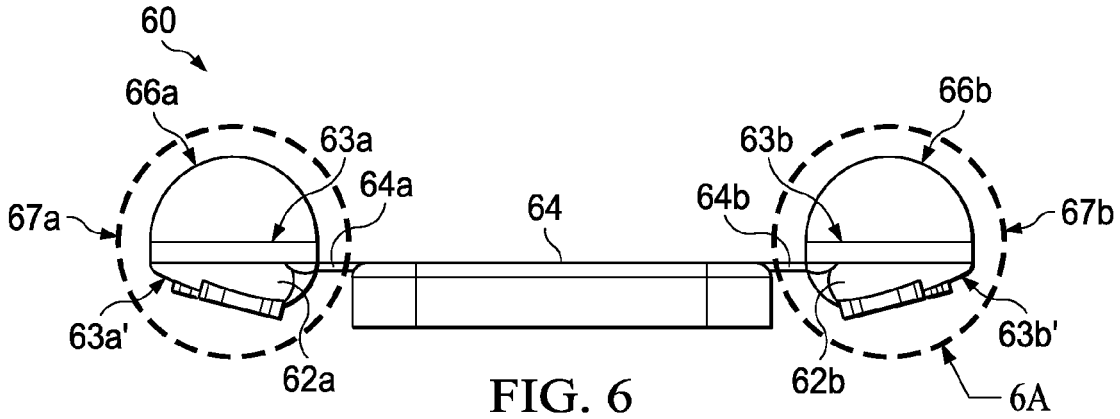
FIGS. 6, 6A, and 6B depict a side view and exploded views of a shaving aid element having a shaving aid portion and a shaving aid holder in accordance with the present invention.

Referring now to FIG. 6, in accordance with the present invention, a side view of a shaving aid element 60 having a shaving aid holder 64 comprised of two wings 62*a* and 62*b* is shown. The shaving aid holder 64 may be hinged to the two wings (e.g., as shown in FIG. 6 via hinges 64*a* and 64*b*). A shaving aid portion 66*a* and 66*b* is disposed on each one of outer and upper surfaces 63*a* and 63*b* of each of the wings 62*a* and 62*b*, forming top and bottom shaving aid elements 67*a* and 67*b*, respectively.

Figure 6A:
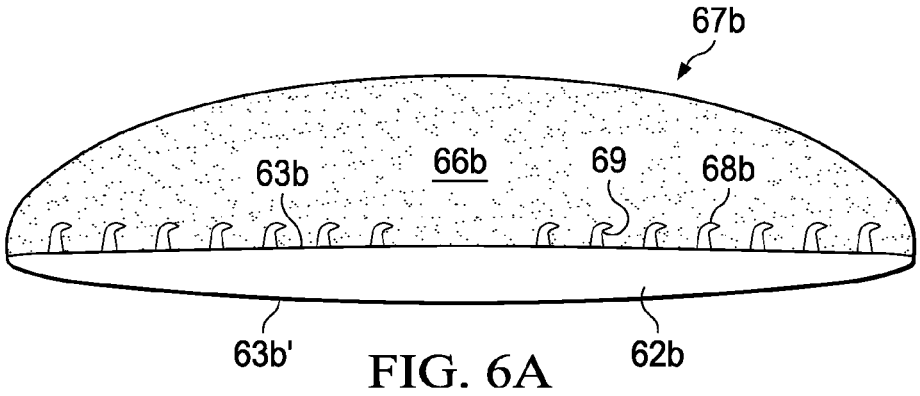

For illustrative purposes, one wing 62*b* is shown in an exploded view in FIG. 6A where outer surfaces 63*a* and 63*b* are depicted as incorporating numerous undercut elements 68*b* which are protrusions that protrude out from outer surfaces 63*a* and 63*b*, and are disposed within the shaving aid portion 66*b*. As depicted in FIG. 6A and as described above with regard to FIG. 4, the undercut elements 68*b* or protrusions may each desirably include hook-like or curved structures 69. The interlock area 65 (shown in exploded view in FIG. 6B) of the shaving aid portion 66*b* formed under the hook-like structure or interlock area 69 of the shaving aid holder may generally be filled with shaving aid portion 66*b* which may initially be in a liquefied form thus adequately able to flow into the interlock area 65 (e.g., or undercut area) and later solidify.

There is desirably no shaving aid portion 66*a* or 66*b* disposed on the outer lower surfaces 63*a*' and 63*b*' of the wings 62*a* and 62*b*.

It should be noted that the shaving aid portion and the wings portion of the shaving aid holder are held together via the interlocking mechanism provided by interlock areas 65 and 69 of undercut elements 68*b*.

As above with FIGS. 4 and 5, there is no necessity in FIG. 6 for over-molding the shaving aid portion as in prior art designs described above where encompassing the outer lower side (or the opposite side) of the shaving aid holder with the shaving aid portion itself to retain the shaving aid portion to the shaving aid holder was generally obligatory.

By being disposed on the outer upper surfaces 63*a* and 63*b* of the wings 62*a* and 62*b*, a 2-in-1 razor is still provided requiring no additional shaving aid to properly shave as the shaving aid portions are aptly disposed where needed so as to contact a user's skin and release the appropriate lubriciousness, and moisturization and other ingredients while shaving.

Figure 6B:
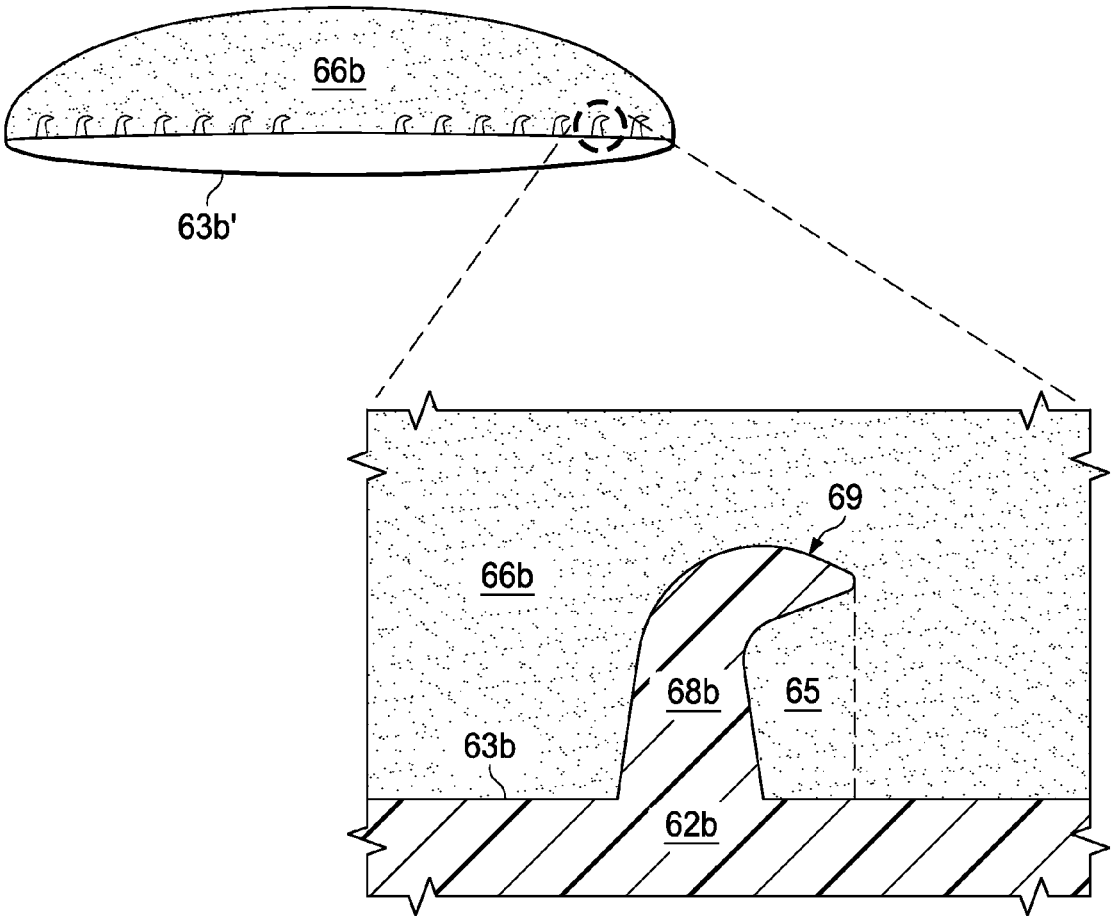

Furthermore, since the shaving aid portions of the present invention, as shown in FIGS. 6, 6A, and 6B for instance, are not desirably disposed on the outer lower surface 63*a*' or 63*b*' of the shaving aid holder 64 (or wings 62*a* and 62*b*). This in turn, allows for a considerable reduction in shaving aid material required per razor cartridge. In general terms, and in particular over the prior art, by not having shaving aid portions below the soap wings (or on the outer lower surface), about half the shaving aid material is conserved. By reducing the amount and consumption of shaving aid material used per razor, the cost per razor may also significantly be reduced where shaving aid materials, such as soap, may commonly be high-priced materials.

In addition, many other advantages of having such a "one-sided" shaving aid portion on a razor cartridge shaving aid holder are manifested in the present invention. For one, quality control issues are generally reduced by about half, with half the amount of shaving aid portion present in the razor cartridge. Further, with less surface area to inspect, it is generally less likely that a surface defect will be present, requiring scrapping of a finished cartridge. Likewise, the need to inspect two sides of the shaving aid portion is eliminated, simplifying the quality control.

In addition, the razor product may desirably appear to be slimmer or sleeker as the bulk of the shaving aid has been removed.

In general, the shaving aid holder 64 may be as specifically shown in FIG. 6, inclusive of a central plastic area 64 where the blade unit is desirably disposed extending to areas provided by the wings 62*a* and 62*b*. However, it should be noted that the shaving aid holder of the present invention may desirably extend to other embodiments, as will be described below, including those where the shaving aid holder is represented by one wing, two wings, a soap ring (e.g., a peripheral area surrounding a blade unit area), and/or a blade unit area in combination with one or two wings.

Figure 7:
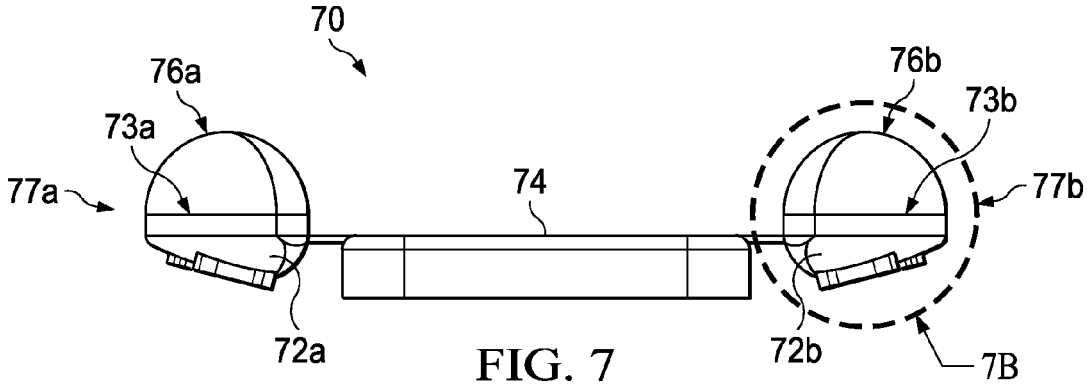
FIGS. 7, 7A, and 7B depict a side view and exploded views of a shaving aid element having a shaving aid portion and a shaving aid holder in accordance with an alternate embodiment of the present invention.
Figure 7A:
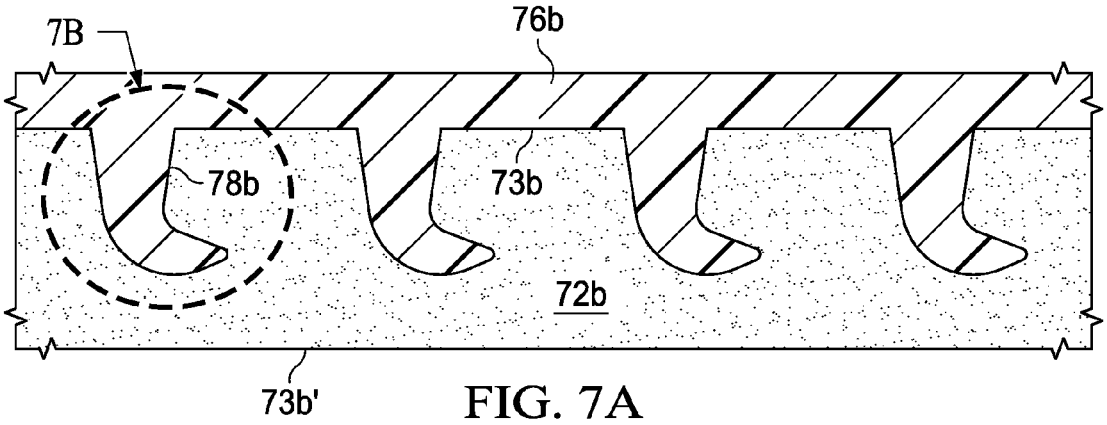
Figure 7B:
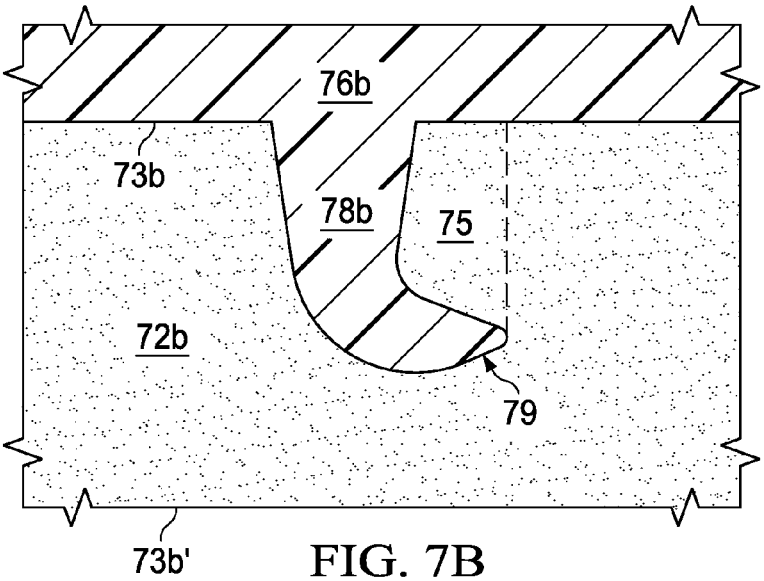

Referring now to FIGS. 7, 7A, and 7B, an alternate embodiment of the present invention is depicted where a side view of a shaving aid element 70 having a shaving aid holder 74 comprised of two portions or wings 72*a* and 72*b* is shown. A shaving aid portion 76*a* and 76*b* is disposed on each one of outer and upper surfaces 73*a* and 73*b*, respectively, of each of the wings 72*a* and 72*b*, forming top and bottom shaving aid elements 77*a* and 77*b*, respectively, as shown in FIG. 7.

For illustrative purposes, a portion of bottom shaving aid element 77*b* is shown in an exploded view in FIG. 7A where outer surfaces 73*a* and 73*b* are depicted as incorporating numerous undercut elements 78*b* which, in contrast to FIGS. 6, 6A, and 6*b*, do not protrude out from outer surfaces 73*a* and 73*b*, but rather are formed within or internal to the shaving aid holder wings themselves. The shaving aid portion 76*b* which initially may be in a liquefied form thus adequately flows into the cavity or recessed type undercut elements 78*b* and solidifies therein.

As depicted in FIG. 7A and as described above with regard to FIG. 5, the undercut elements 78*b* may each desirably include hook-like or curved structures or interlock area 79 of the shaving aid portion. The undercut or interlock area 75 (shown in exploded view in FIG. 7B) formed under the hook-like structure interlock area 79 is generally comprised of a polymeric material in that it is generally formed of the same material used for the shaving aid holder or wings in this case.

Figure 1A:
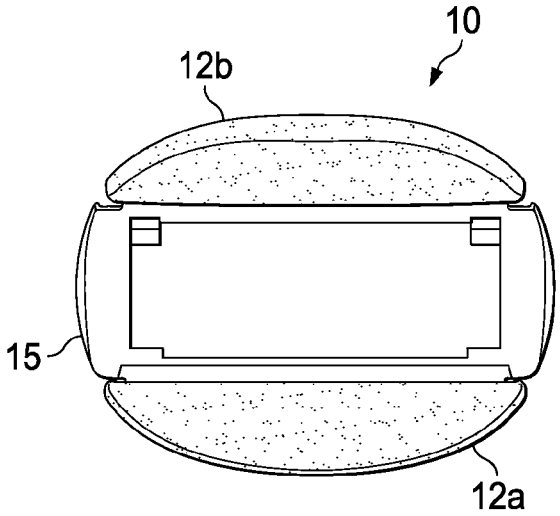
FIG. 1A (PRIOR ART)
Figure 2:
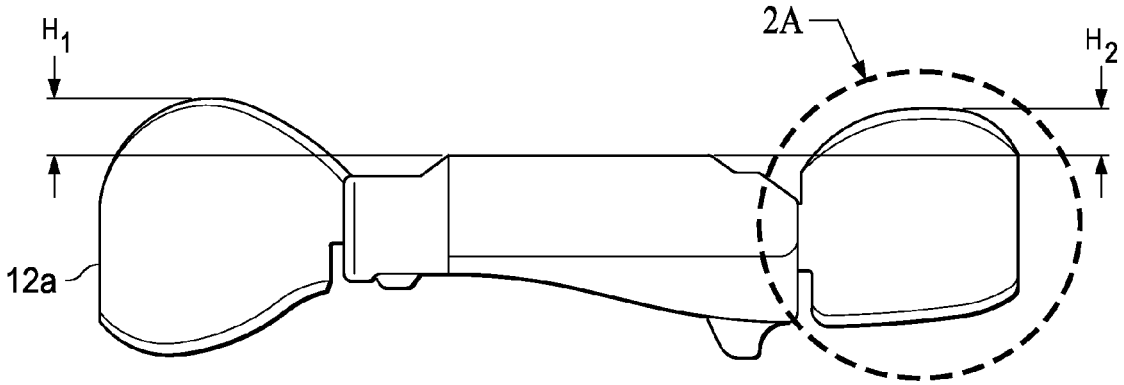
FIG. 2 (PRIOR ART)
FIGS. 2 and 2A are a side view of the shaving aid portion(s) of FIGS. 1 and 1A.
Figure 2A:
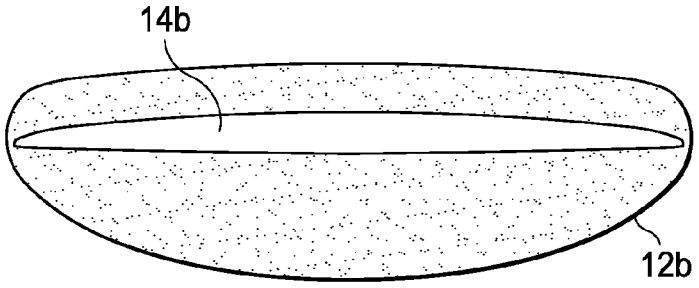
FIG. 2A (PRIOR ART)
Figure 3A:
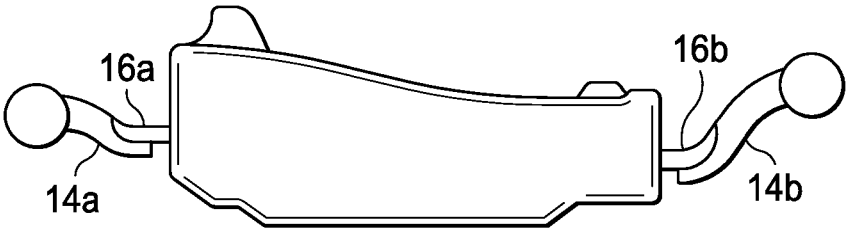
FIG. 3A (PRIOR ART)
FIG. 3A is a side view of a shaving aid holder of FIG. 2 without the shaving aid portions disposed thereon, showing two shaving aid holders or wings.
Figure 3B:
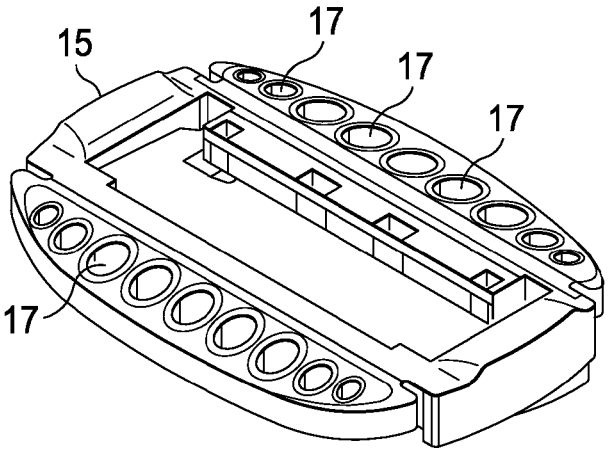
FIG. 3B (PRIOR ART)
FIGS. 3B and 3C are perspective and top views, respectively, of a prior art embodiment of a shaving aid holder having apertures.
Figure 3C:
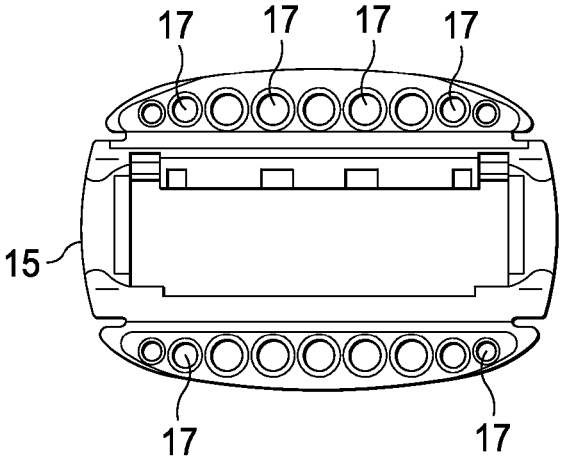
FIG. 3C (PRIOR ART)

Referring now to FIGS. 8A to 8E, cross-sectional side views of various shaving aid holders, each having at least one undercut element protruding therefrom, are shown in accordance with the present invention. To illustrate the novelty of the present invention the shaving aid holders are depicted without the shaving aid portion disposed thereon. The shaving aid holders shown in FIGS. 8A to 8E may be in the form of wings as described above in conjunction with above FIGS. 6-7, oval or round shaped, or any other shape or structure feasibly desired. The shaving aid holders shown in FIGS. 8A to 8E may desirably be incorporated into razor cartridges disposed in any arrangement around the periphery of the cartridge or as wings and coupled with any razor handle, such as depicted in FIGS. 1 and 1A, forming a razor which can be used to shave.

Figure 8A:
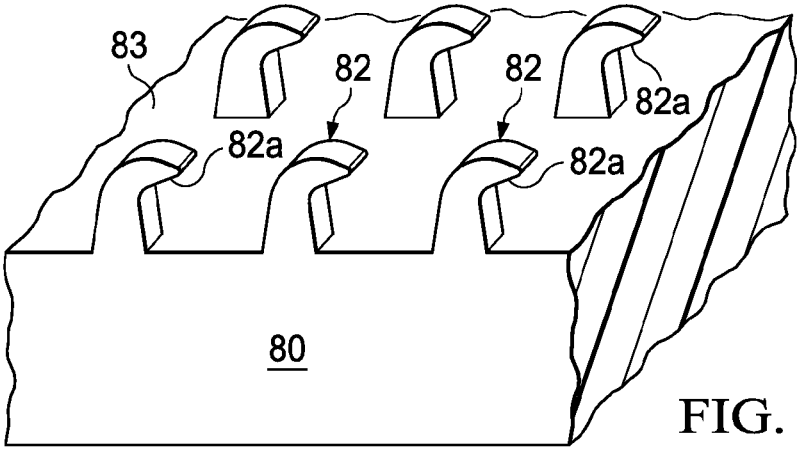
FIGS. 8A to 8E depict cross-sectional views of various embodiments of undercut elements incorporated on the shaving aid holder of the present invention.
Figure 8B:
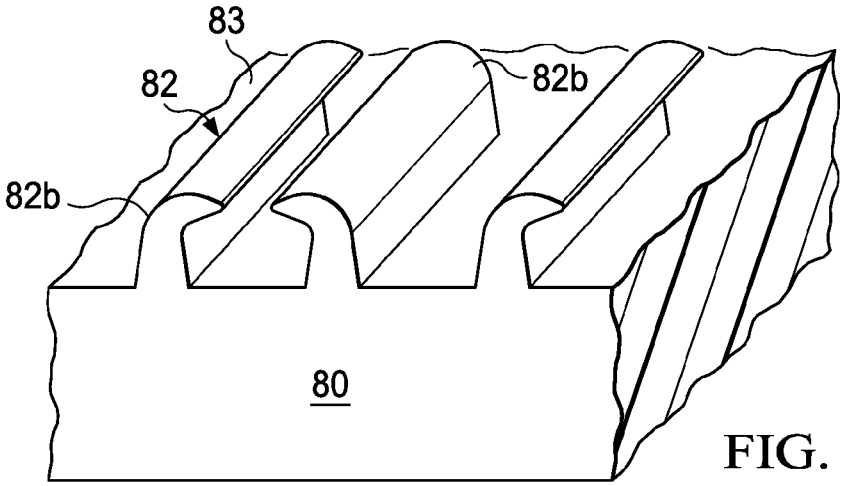
Figure 8C:
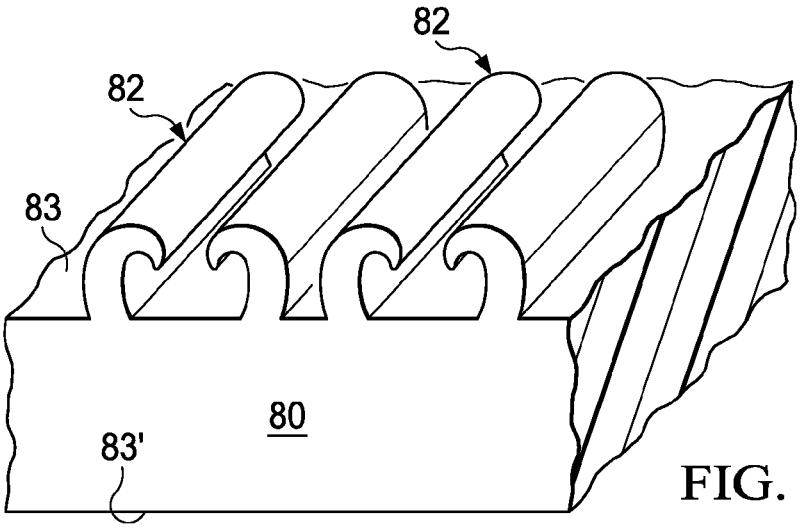
Figure 8D:
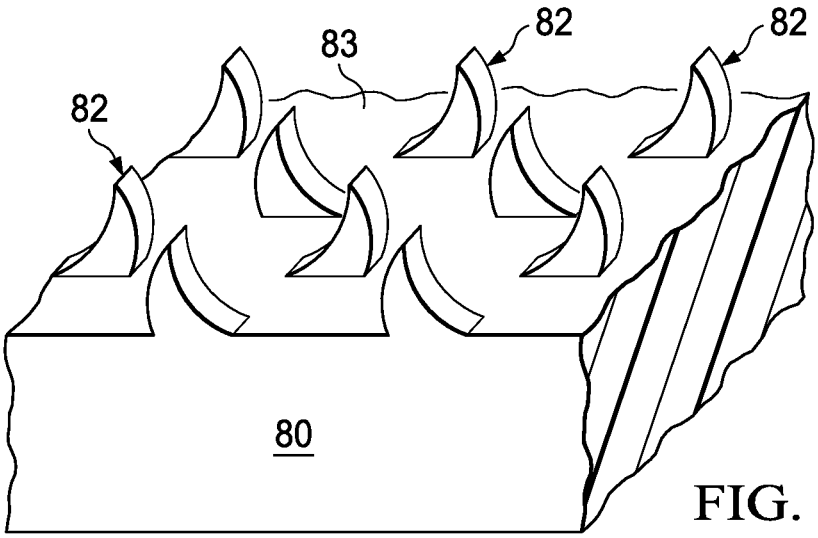
Figure 8E:
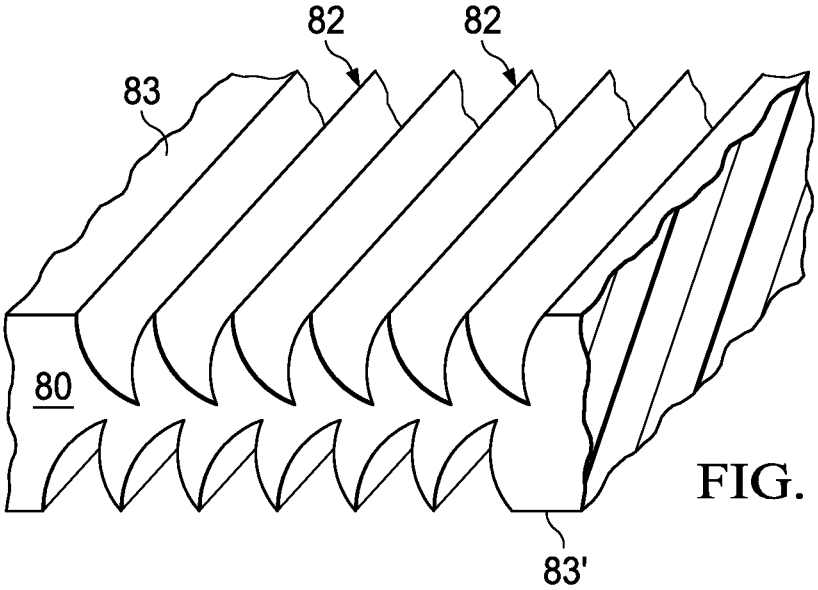

FIG. 8A depicts a novel shaving aid holder 80 having undercut elements 82 with hook-like structures 82*a* incorporated onto an outer upper surface 83 of shaving aid holder 80. Curved, smooth, or contour surfaces 82*b* may also be desirably present in the novel shaving aid holders of the present invention in that, in case the shaving aid portion disposed on the shaving holder wears away completely, or substantially completely, the user does not feel anything sharp or uncomfortable on their skin. The hook like structure 82*a* or curved surface 82*b* generally curve toward the upper surface 83 of shaving aid holder 80. Undercut elements with hook-like structures 82*a* and curved surfaces 82*b* are desirably disposed throughout the outer upper surface of the shaving aid holder. As can be seen in FIGS. 8B through 8E, any pattern and type of undercut elements are contemplated in the present invention. In FIG. 8E for instance, it is also noted that the outer lower surface 83' of the shaving aid holder 80 is not a smooth or straight surface but rather may itself molded with indentations, cavities, hook-like structures, or depressions which, as depicted, may also be of similar form as the shape of the undercut elements 82.

Figure 9A:
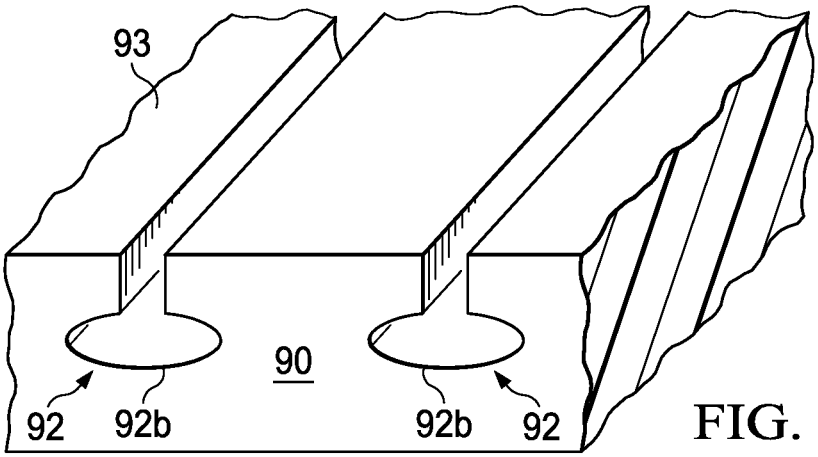
FIGS. 9A to 9C depict cross-sectional views of various alternate embodiments of undercut elements incorporated on the shaving aid holder of the present invention.
Figure 9B:
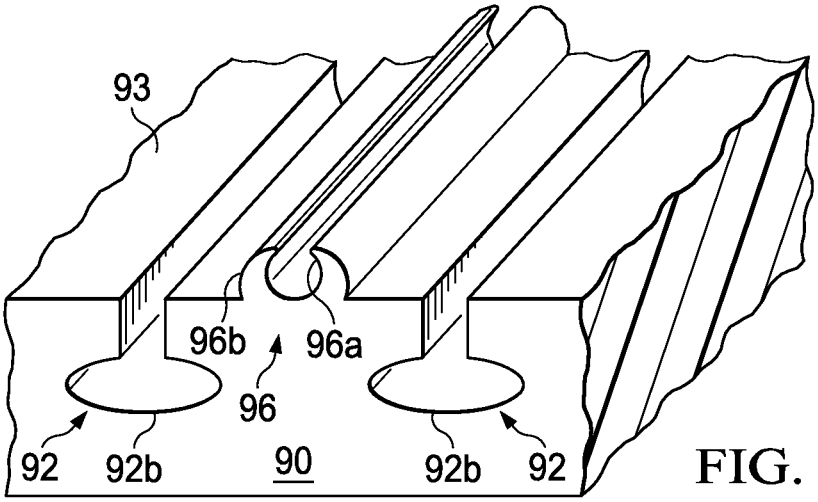
Figure 9C:
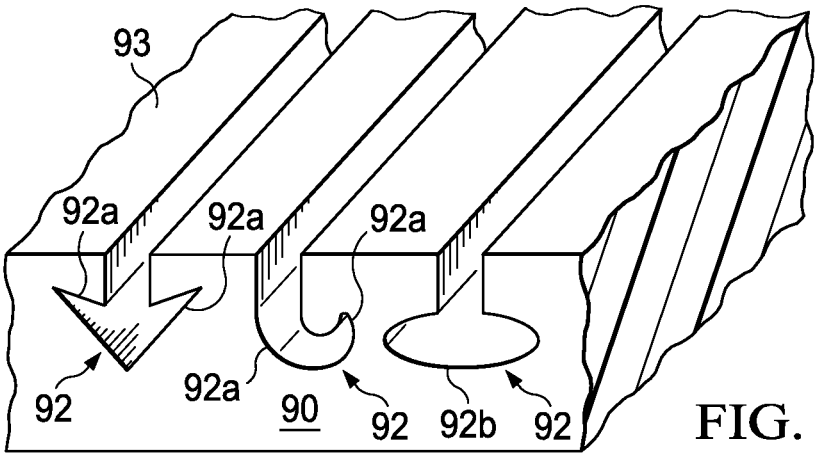

Referring to FIGS. 9A-9C, shown are cross-sectional side views of alternate embodiments of novel shaving aid holders 90 having undercut elements 92 with both hook-like structures 92*a* and smooth contours 92*b* (and undercut element 96 having both hook-like structures 96*a* and smooth contours 96*b*) incorporated onto an outer upper surface 93 of shaving aid holder 90 in accordance with the present invention. In contrast to those shown in FIGS. 8A to 8E, the undercut elements 92 in FIGS. 9A to 9C (with the exception of undercut element 96 in FIG. 9B) do not protrude from outer upper surface 93 of shaving aid holder 90, but are formed within or internal to the shaving aid holder 90 as similarly described above in conjunction with FIGS. 7 to 7B. FIG. 9B depicts a combination of both types of undercut elements, depicting protruding undercut elements 96 and undercut elements 92 incorporated internal to the shaving aid holder; a combination of types of undercut elements is also contemplated in the present invention. It is also noted that many of the undercut elements 92 of FIGS. 9A to 9C have mostly smooth, curved or rounded contours 92*a*, whereas internal undercut elements 92 of FIG. 9C for instance includes hook-like structures 92*a* in addition to a smooth, or contoured surface 92*b*. Similarly, protruding undercut elements 96 in FIG. 9B also desirably includes hook-like structures 96*a* while also having a smooth or contoured surface 96*b*.

Figure 10A:
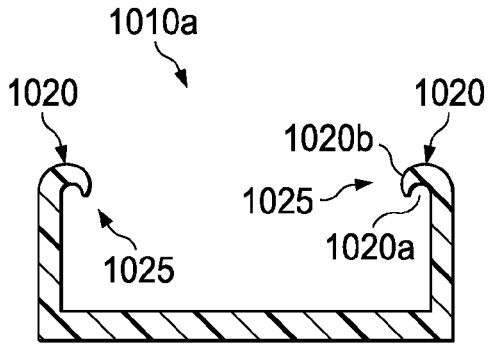
FIGS. 10A to 10I depict cross-sectional views of still further embodiments of undercut elements incorporated on the shaving aid holder of the present invention.
Figure 10B:
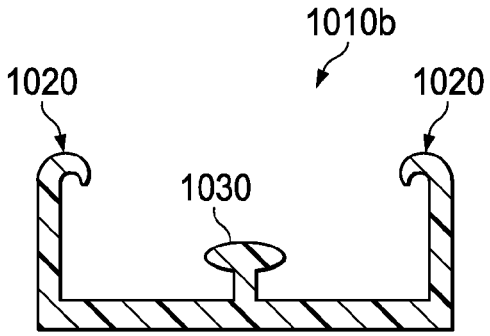
Figure 10C:
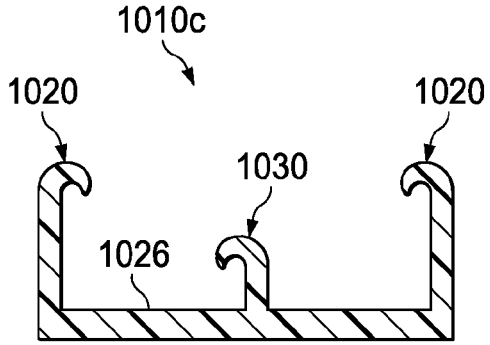
Figure 10D:
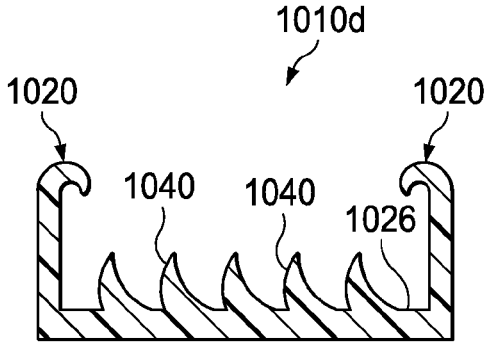
Figure 10E:
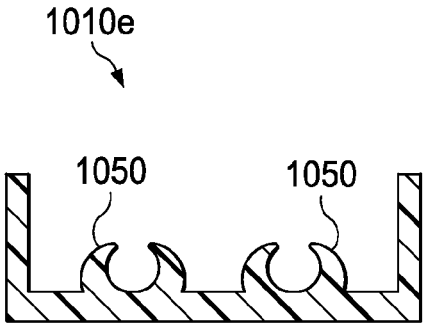
Figure 10F:
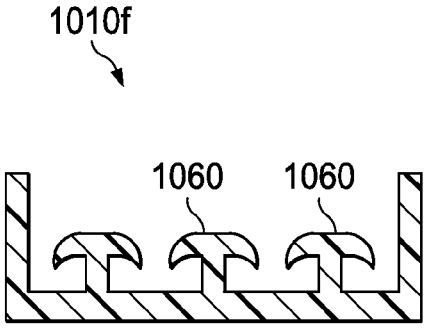

Referring now to FIGS. 10A to 10I, cross-sectional side views of shaving aid holders within the scope of further alternate embodiments of the present invention are depicted: In FIG. 10A, one undercut element 1020 having hook-like structure 1020*a* and smooth contour 1020*b*, may be desirably disposed in at least a portion of a peripheral area 1025 of shaving aid holder 1010*a* as shown in FIG. 10A; as shown in embodiments of FIGS. 10B and 10C, one undercut element 1020 may desirably be disposed in at least a portion of peripheral area 1025 of shaving aid holders 1010*b* and 1010*c* and one additional undercut element 1030 may desirably be disposed in an upper surface of the internal base 1026 of the shaving aid holders 1010*b* and 1010*c*; in FIG. 10D, another embodiment depicts one undercut element 1020 desirably disposed in at least a portion of a peripheral area 1025 of shaving aid holders 1010*d* and two or more undercut elements 1040 are disposed in an upper surface of the internal base 1026 area of the shaving aid holder 1010*d*; in FIGS. 10E and 10F undercut elements 1050 and 1060, respectively, are disposed only in the internal base area 1026 of the shaving aid holders 1010*e* and 1010*f* (with no undercut elements in the peripheral area of the shaving aid holders).

The undercut elements of FIGS. 10A to 10I are depicted as being of varying types, some with one or more hook-like structures and/or one or more curved contours. One advantage of having the undercut elements as depicted in FIGS. 10B to 10F on the internal base area 1026 of the shaving aid holders is to provide increased mechanical interlocking and improved retaining of the shaving aid portion with the shaving aid holder.

Figure 10G:
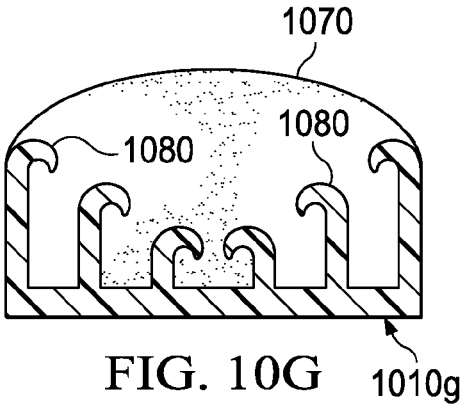
Figure 10H:
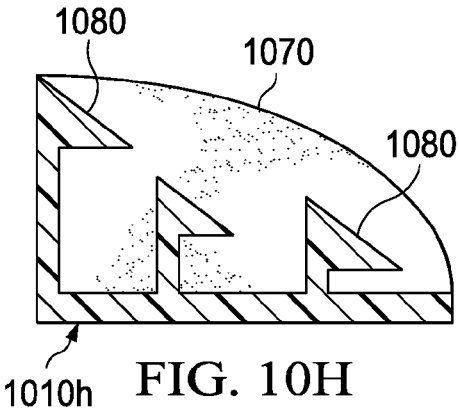
Figure 10I:
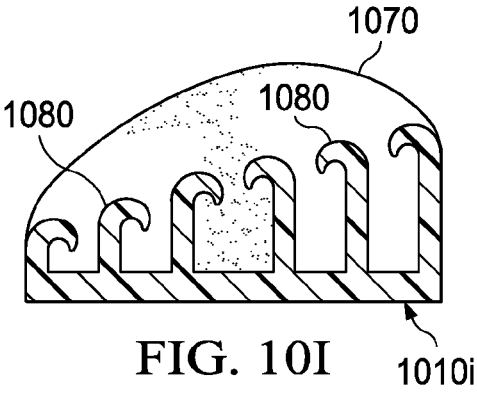

In FIGS. 10G to 10I, the undercut elements 1080 of shaving aid holders 1010*g*, 1010*h*, and 1010*i* each having shaving aid portions 1070 do not necessarily have to be at the same heights in accordance with the present invention. As shown in FIG. 10G, the heights of the undercut elements 1080 may decrease and then increase (as shown, left to right), or as shown in FIG. 10H, the undercut elements 1080 may decrease from left to right or as shown in FIG. 10I, the heights of the undercut elements 1080 may increase from left to right which may desirably allow for a shaving aid portion 1070 to be disposed in the same manner (e.g., forming an angle).

Figure 11A:
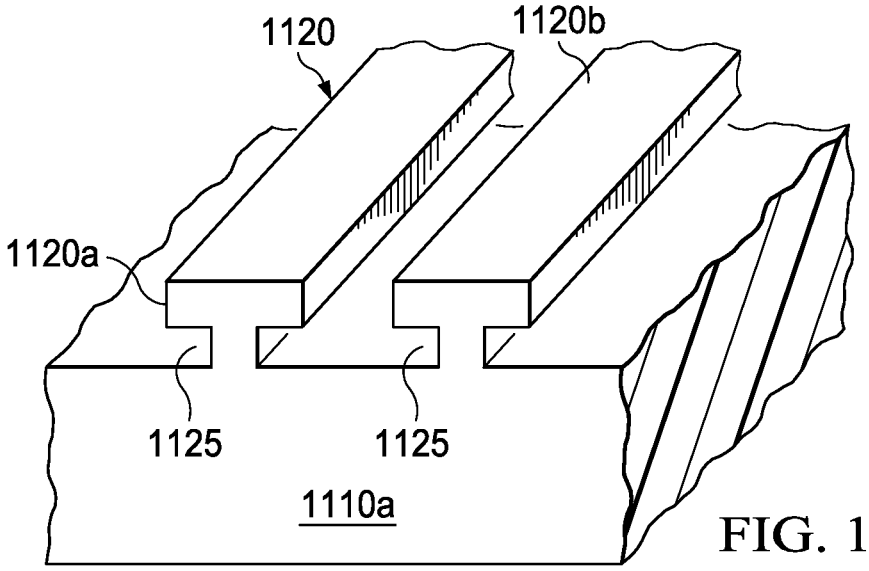
FIGS. 11A to 11D depict cross-sectional views of yet still further various embodiments of undercut elements incorporated on the shaving aid holder of the present invention.
Figure 11B:
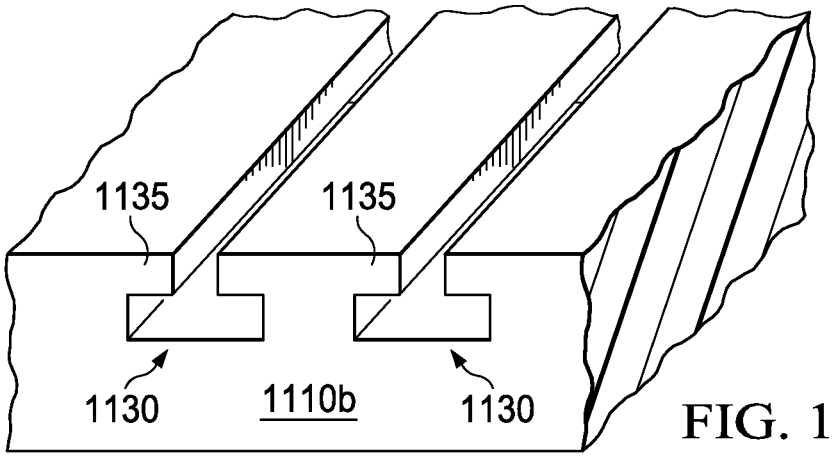

In FIGS. 11A and 11B, still further embodiments of the present invention are shown where undercut elements 1120 and 1130 are provided on shaving aid holders 1110*a* and 1110*b*, (not shown in their entirety) respectively, where undercut elements 1120 are protruding from shaving aid holder 1110*a* and undercut elements 1130 are internal to the shaving aid holder 1110*b*. Additionally, as depicted, the undercut element 1120 has no "hook-like structure" but rather a squared off shape or straight-line structure 1120*a* and a flat smooth upper surface 1120*b* rather than a curved contoured one. In this way, the mechanical interlocking of the shaving aid holder and the shaving aid portion (not shown) is still provided as there is still an undercut or interlock area 1125 which desirably may be filled with shaving aid portion (not shown) disposed in an area beneath the undercut element 1120, as similarly described in conjunction with FIG. 4 above. In the case of FIG. 11B, as described with FIG. 5, there is an interlock area 1135 formed as part of the shaving aid holder 1110*b*.

Figure 11C:
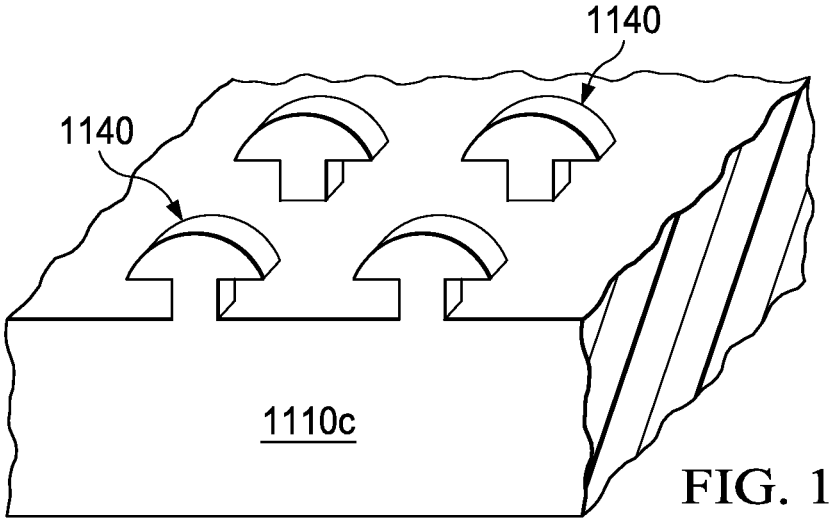
Figure 11D:
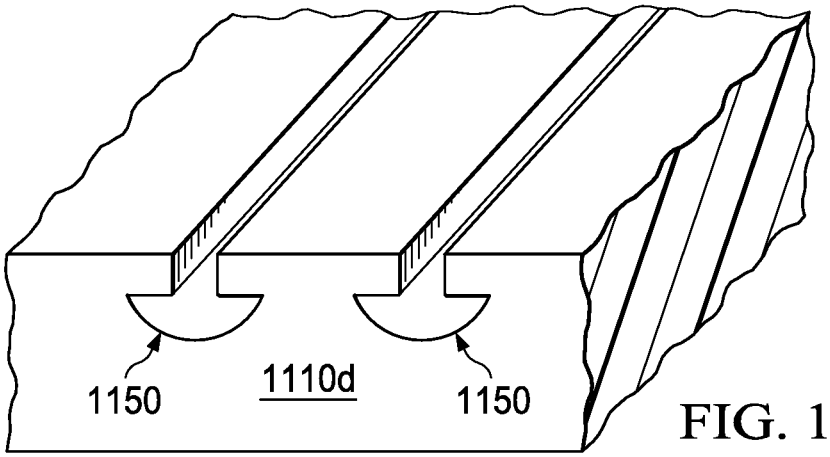

In FIGS. 11C and 11D, still further embodiments of the present invention are shown where undercut elements 1140 and 1150 are provided on shaving aid holders 1110*c* and 1110*d*, respectively, where undercut elements 1140 are protruding from shaving aid holder 1110*c* and undercut elements 1150 are internal to the shaving aid holder 1110*d*. Additionally, as depicted, the undercut elements 1140 and 1150 have a "mushroom" shape rather than a "hook-like structure" or a squared off shape or straight-line structure.

Figure 12A:
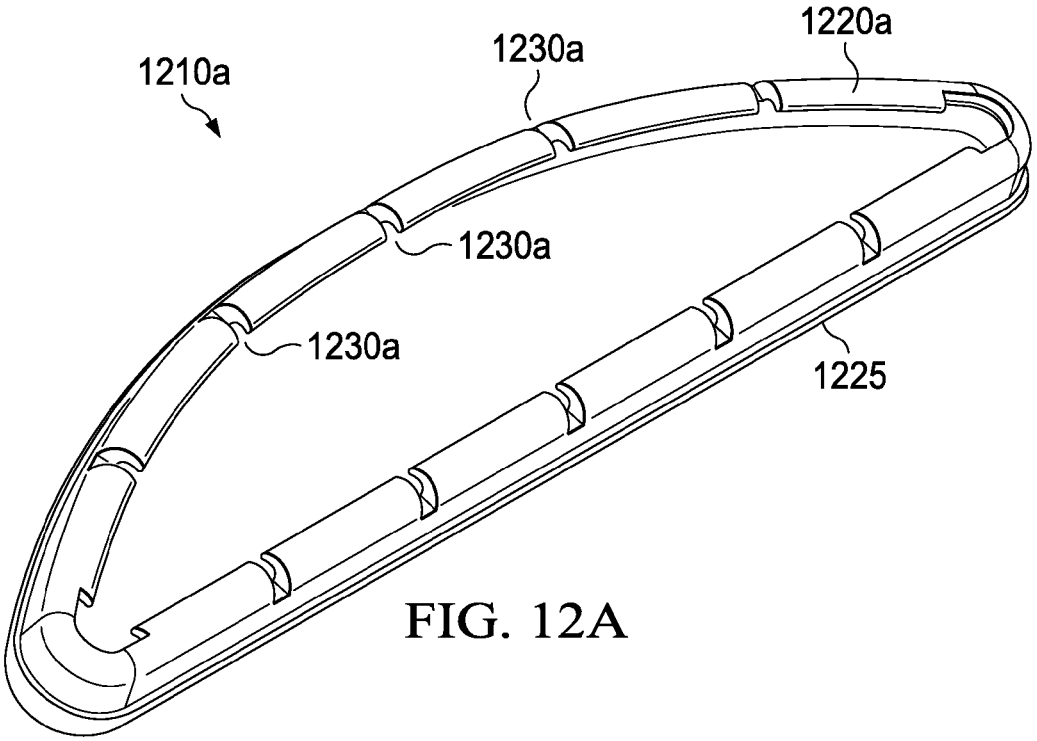
FIGS. 12A to 12C depict perspective views of shaving aid holders in accordance with the present invention.
Figure 12B:
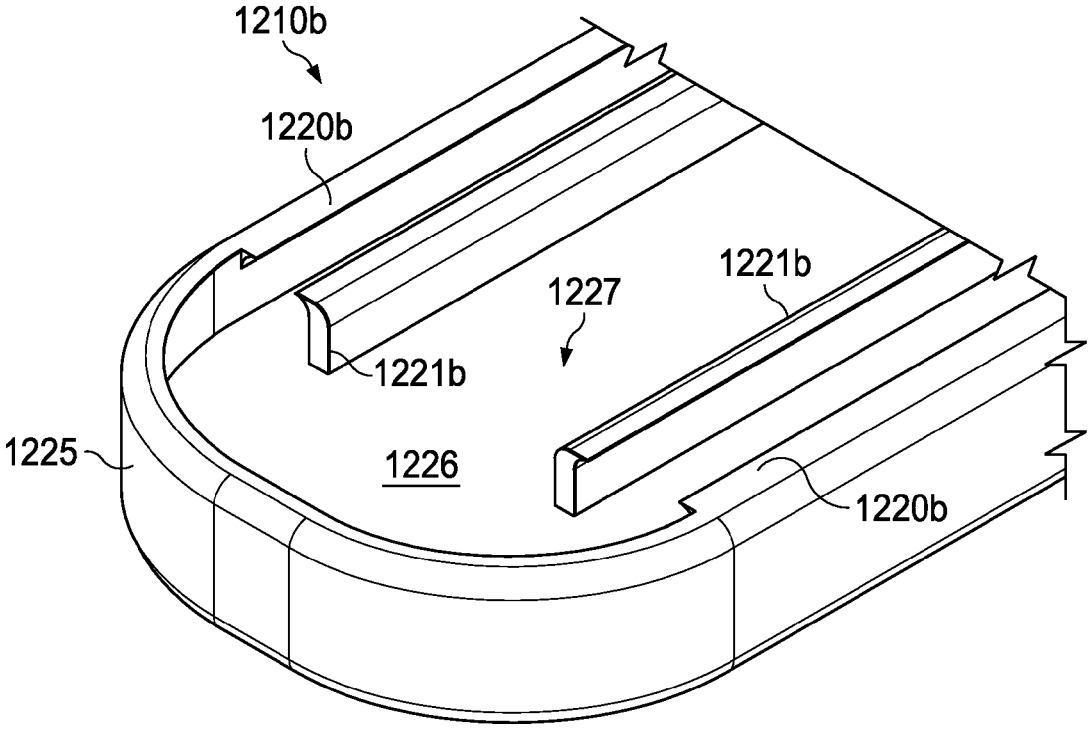
Figure 12C:
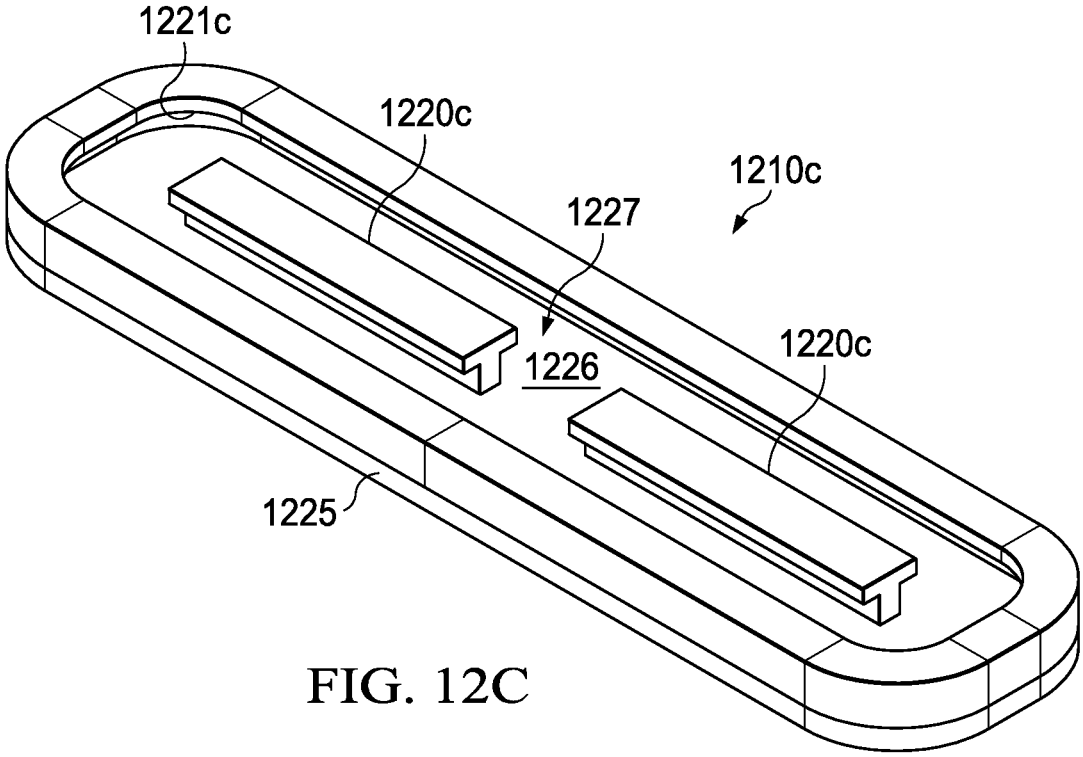

FIGS. 12A through 12C depict various embodiments of shaving aid holders in accordance with the present invention (each shown without shaving aid portion). The shaving aid holders contemplated by the present invention may generally take any shape and be coupled to the razor cartridge in any manner. For instance, the shaving aid holder may include one piece or one wing, two wings or more, or a ring around the periphery of the razor cartridge.

A perspective view of an embodiment of shaving aid holder 1210*a* of the present invention is shown in FIG. 12A where one undercut element 1220*a* is disposed substantially around the entire peripheral area 1225, the latter having intermittent gaps 1230*a*. This shaving aid holder may be similar to the embodiment shown in FIG. 10A which depicts shaving aid holder 1010*a*.

Shaving aid holder 1210*a* shown in FIG. 12A may desirably represent either the only shaving aid holder coupled to the razor cartridge (e.g., one wing) or it may be coupled with a razor cartridge having two such shaving aid holders (e.g., two wings), or any other feasible arrangement.

A perspective view of a shaving aid holder 1210*b* of the present invention is shown in FIG. 12B having three undercut elements at substantially the same height, one undercut element 1220*b* being disposed around the peripheral area 1225, and two similar undercut elements 1221*b* being desirably disposed in the upper surface 1226 of the internal base 1227 of the shaving aid holder. This shaving aid holder 1210*b* may be likened to, though not identical, shaving aid holder 1010*c* shown in FIG. 10C.

As with FIG. 12A, the shaving aid holder 1210*b* may desirably represent the only shaving aid holder in a razor cartridge (e.g., one wing) or a razor cartridge may be coupled to two such shaving aid holders (e.g., two wings), or any other feasible arrangement.

A perspective view of still yet another embodiment of a shaving aid holder 1210*c* is shown in FIG. 12C, where an undercut element 1220*c* (similar to the type described in FIG. 11A) is disposed in an upper surface 1226 of internal base 1227 of a shaving aid holder 1210*c* having substantially the same height as the height of peripheral area 1225 of the shaving aid holder 1210*c*. Though shown with undercut element 1221*c*, peripheral area 1225 may or may not have an undercut element disposed thereon.

Figure 13A:
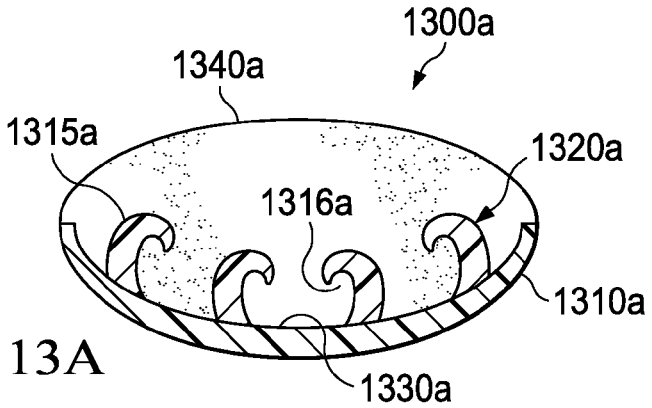
FIGS. 13A to 13C depict still further alternate embodiments of shaving aid elements of the present invention.

Referring now to FIG. 13A, a cross-sectional side view of another embodiment of a shaving aid element 1300*a* of the present invention having a shaving aid holder 1310*a* and shaving aid portion 1340*a* where the shaving aid holder 1310*a* desirably has a convex shape. Undercut elements 1320*a* protrude from an upper surface 1330*a* of the shaving aid holder 1310*a* and a shaving aid portion 1340*a* is disposed thereon. Undercut elements 1320*a* desirably include interlock areas of the shaving aid holder 1315*a* having a hook-like shape and interlock areas of the shaving aid portion 1316*a*, as shown. Interlock areas of the shaving aid holder and shaving aid portion 1315*a* and 1316*a*, respectively, desirably provide an interlocking mechanism for retaining shaving aid holder and shaving aid portion together.

Figure 13B:
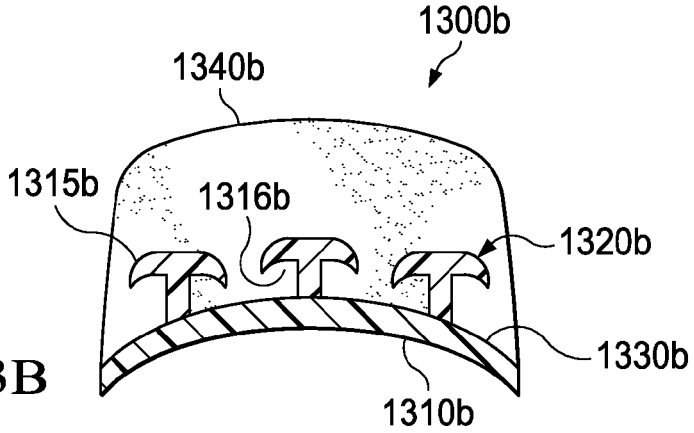

In FIG. 13B, a cross-sectional side view of another embodiment of a shaving aid element 1300*b* of the present invention having a shaving aid holder 1310*b* and shaving aid portion 1340*b* where the shaving aid holder 1310*b* desirably has a concave shape. Undercut elements 1320*b* protrude from an upper surface 1330*b* of the shaving aid holder 1310*b* and a shaving aid portion 1340*b* is disposed thereon. Mushroom shaped undercut elements 1320*b* desirably include interlock areas of the shaving aid holder 1315*b* and interlock areas of the shaving aid portion 1316*b* as shown. As in FIG. 13A, interlock areas of the shaving aid holder and shaving aid portion, 1315*b* and 1316*b*, respectively, desirably provide an interlocking mechanism for retaining shaving aid holder 1310*b* and shaving aid portion 1340*b* together.

Figure 13C:
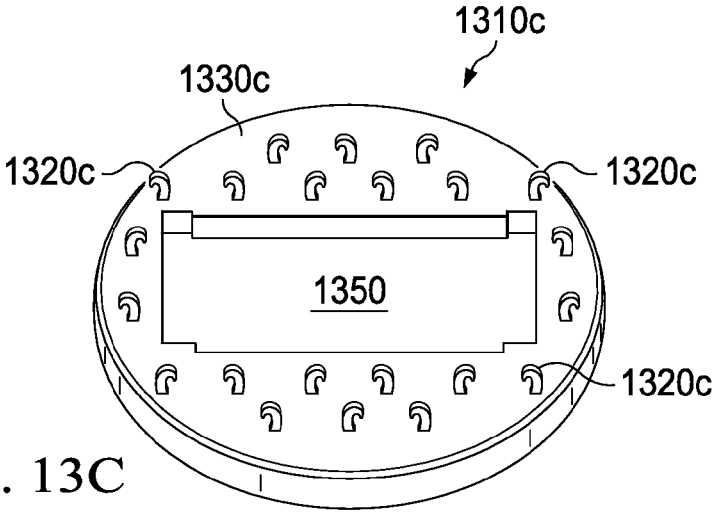

In FIG. 13C, a top view of another embodiment of the present invention is shown having a shaving aid holder 1310*c* (shown without shaving aid portion disposed thereon) where the shaving aid holder 1310*c* desirably has, thought is not limited to, an oval or circular shape and central opening 1350 which if rectangular shaped as shown, may be utilized for placement of the razor cartridge (e.g., as in the Schick Intuition products). Undercut elements 1320*c* protrude from an upper surface 1330*c* of the shaving aid holder 1310*c*. The shaving aid portion (not shown) may desirably have the same overall shape as the shaving aid holder (e.g., oval or circular or any other feasible shape) as it is generally disposed on top of the shaving aid holder. As before, interlock areas formed by the undercut element (e.g., of the shaving aid holder and shaving aid portion) would desirably provide an interlocking mechanism for retaining shaving aid holder and shaving aid portion together.

In the embodiments of the present invention described thus far, and in contrast with the prior art, the shaving aid holders are not shown or described as having any apertures. While the prior art used apertures in the shaving aid holder as the mechanism in which to retain the shaving aid portion within the shaving aid holder (e.g., in order to over-mold), the present invention does not need this functionality. However, the present invention does contemplate the shaving aid holder may have one or more apertures with the caveat that these apertures, if present, may serve a different purpose than that of retaining a shaving aid portion (e.g., gate) or may desirably not be the sole mechanism for retaining or interlocking the shaving aid portion within the shaving aid holder since undercut elements of the instant invention are also present to provide an interlocking mechanism for retaining shaving aid holder and shaving aid portion together.

One purpose contemplated in the present invention for having one or more apertures in the shaving aid holder may be to provide a mechanism in the process of supplying the shaving aid portion to the shaving aid holder.

Figure 14:
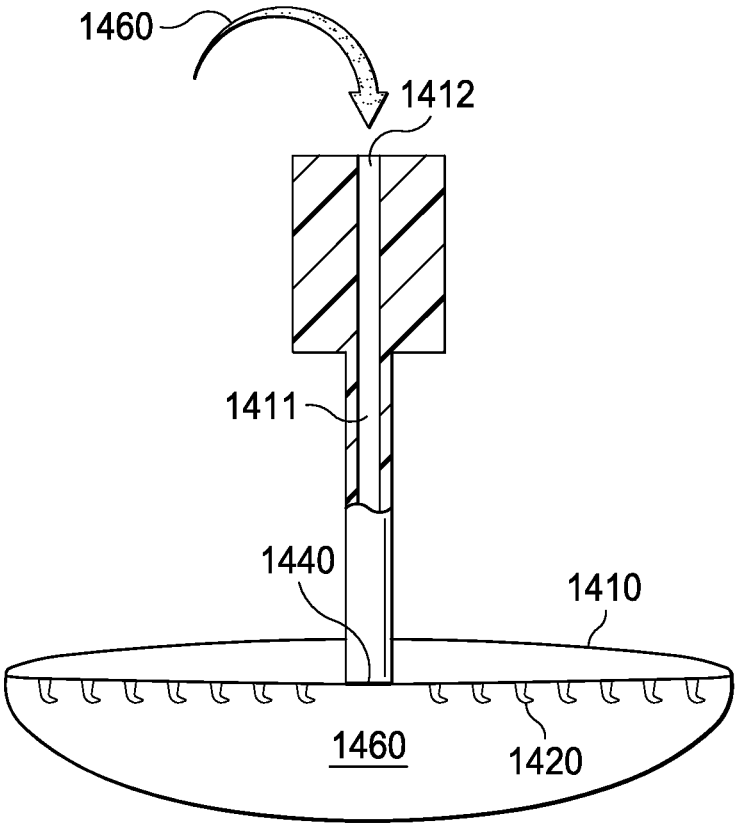
FIGS. 14 and 15 depict a method of forming a shaving aid element having a shaving aid portion incorporated with a shaving aid holder in accordance with the present invention.
Figure 15:
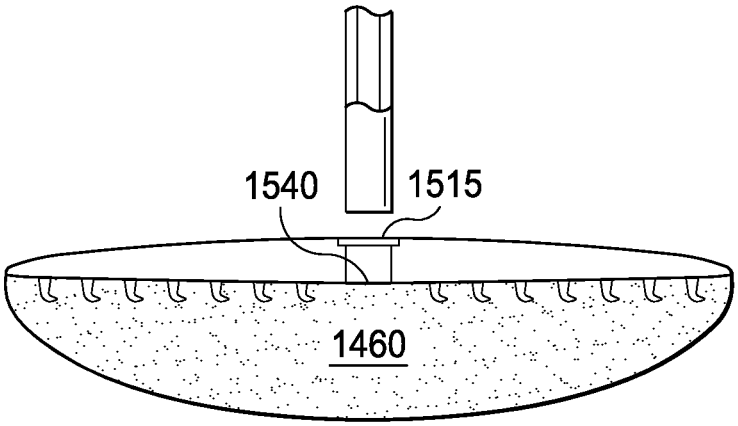

As depicted in FIG. 14, a process is described wherein a channel 1411 with an opening 1412 at the top, into which the shaving aid portion 1460 (desirably in a fluid state) is submitted into and injected into an aperture or gate 1440 of the shaving aid holder 1410 having undercut elements 1420 with hook-like structures and curved surfaces into the area of a mold. After being injected, the shaving aid portion will desirably solidify in the mold and when the mold is subsequently removed the shaving aid portion with the shaving aid holder are interlocked together. Subsequently, the channel may be removed from the aperture 1540 as shown in FIG. 15 after this injection step is completed. It should be noted that even with the aperture present after completion and solidification of the shaving aid portion, the aperture has served only as the injection point for the shaving aid portion and not as a retaining or interlocking mechanism. In particular, it should be noted, that there is desirably no shaving aid portion on the lower side of the shaving aid holder in accordance with the present invention. Moreover, if desired, the aperture may later be covered or closed with a cover or seal 1515 of any feasible type, ostensibly to hide the area of the aperture from consumer view thereby improving the appearance of the cartridge, as shown in FIG. 15.

Figure 16:
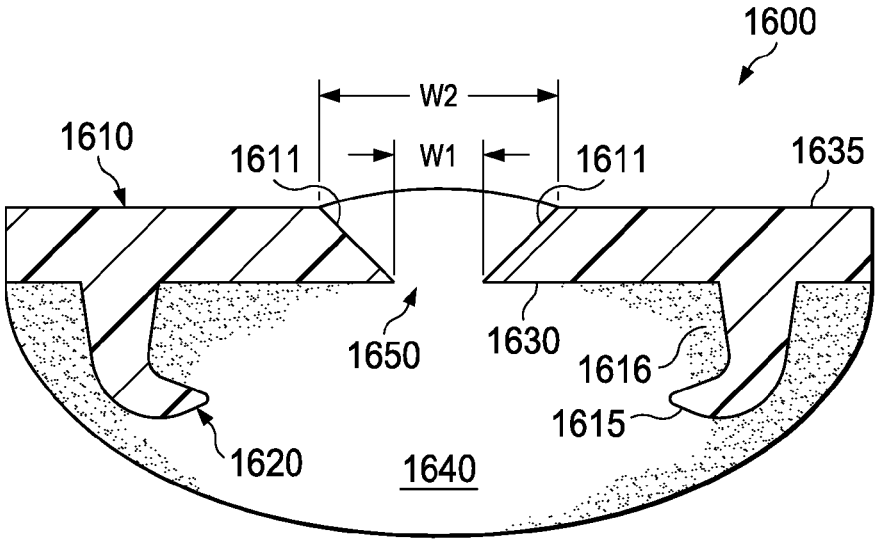
FIG. 16 depicts a cross-sectional side view of a still further embodiment of the shaving aid element of the present invention.

Referring now to FIG. 16, a cross-sectional side view embodiment of a shaving aid element 1600 of the present invention is shown having a shaving aid holder 1610 with both undercut elements 1620 protruding from an upper surface 1630 of the shaving aid holder 1610 and an aperture 1650 therein. Undercut elements 1620 have a hook-like shape where each element has interlock areas of the shaving aid holder 1615 and shaving aid portion 1616 as shown. Aperture 1650 may serve as a gate or injection point and be left uncovered and/or may serve as an additional means of retention for the shaving aid portion to the shaving aid holder. As depicted, shaving aid portion 1640 may cross over the lower surface 1635 of the shaving aid holder 1610 such that, though not necessary in the present invention, some additional retention for the shaving aid element may be provided.

In addition, it should be noted, the shaving aid holder 1610 may have angled side walls 1611 tapered inward or outward toward the aperture opening 1650 at lower surface 1635 (shown tapering outward toward aperture 1650 in FIG. 16) in a manner which may also provide an added retaining mechanism of the shaving aid portion 1640 to the shaving aid holder 1610. In this case, the aperture opening width W1 at the upper surface 1630 of the shaving aid holder 1610 may be smaller than the aperture opening width W2. In lieu of side walls 1611, the shaving aid holder 1610 may have any shape forming the aperture in accordance with the present invention (e.g., rounded or curvy).

The present invention as described contemplates an embodiment of a shaving aid element where there are undercut elements incorporated on an upper surface of the shaving aid holder.

The present invention also contemplates an embodiment of a shaving aid element where there is no shaving aid portion on the lower surface of the shaving aid holder (which has undercut elements on its upper surface), the shaving aid holder with or without apertures therein; but when apertures are desirably present, they are generally used for injecting the shaving aid portion to form the shaving aid element and not as a retention mechanism.

Additionally, the present invention contemplates the embodiment of a shaving aid element with mixed retention capabilities where a shaving aid holder includes undercut elements and apertures, where the apertures may serve as a retention mechanism, supplementing the retention mechanism provided by the undercut elements.

Figure 17:
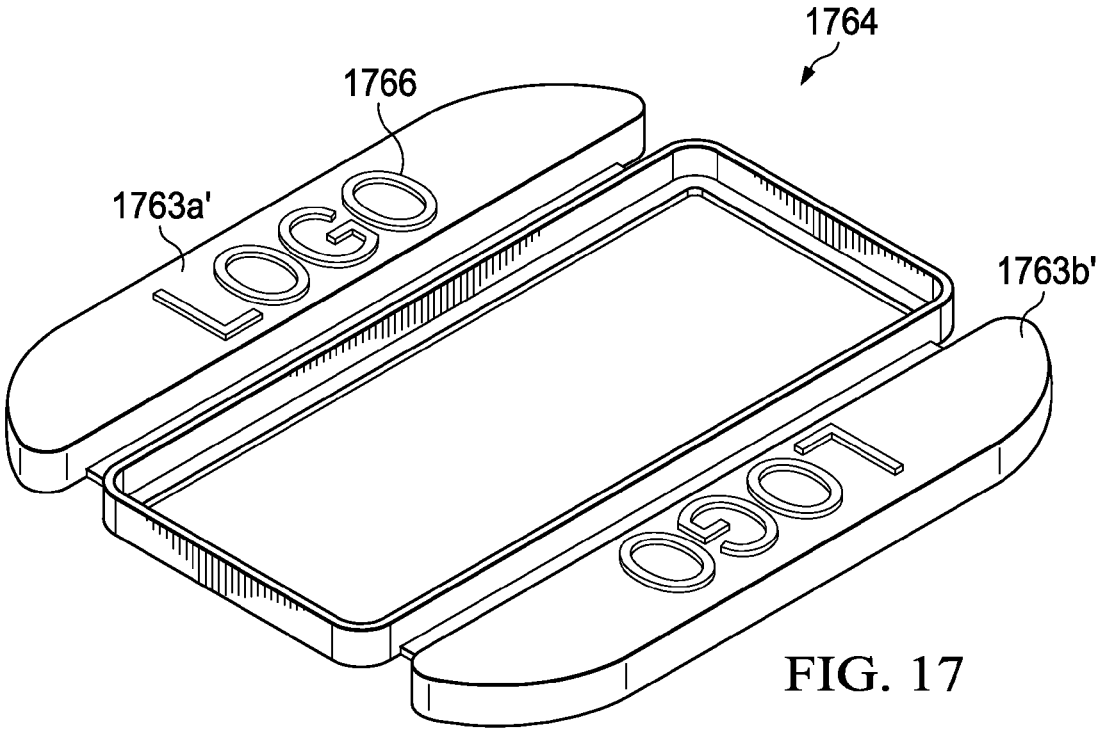
FIG. 17 depicts a perspective view of shaving aid holders having aesthetic elements incorporated thereon in a still further alternate embodiment of the present invention.

In the embodiments of the present invention where there is effectively no shaving aid portion on the lower surface of the shaving aid holder, that lower surface, now exposed, may desirably be made available for disposing indicia or other markings such as trademarks, designs, graphics, text, or other aesthetic elements, etc. or any combination thereof, thereon. Referring to FIG. 17, for instance, by having outer lower surfaces 1763*a*' and 1763*b*' of shaving aid holder 1764 now exposed (e.g., no shaving aid portion), a product designer may obtain a new freedom to utilize that one or more surfaces for markings or trade names 1766 as shown in FIG. 17. It should be noted that any type of graphic or indicia or other design enhancing or useful marketing element is contemplated in the present element for placement on outer lower surfaces 1763*a*' or 1763*b*' of the shaving aid holder 1764.

Figure 18:
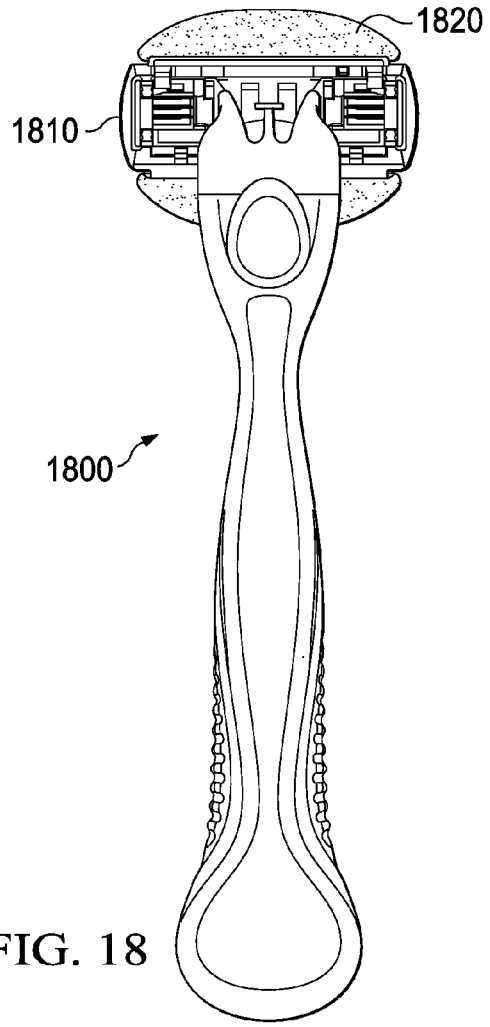
FIG. 18 depicts a back view of razor system showing a shaving aid holder having functional elements incorporated thereon in a still further alternate embodiment of the present invention.

In addition to a surface for designs or disposing markings or other aesthetic elements, the exposed outer surface of the shaving aid holder, when essentially free of soap and desirably with few or no apertures may be utilized to provide functional benefits for the user. These benefits include, but would not be limited to, such benefits as skin engagement or conditioning, exfoliation, added ingredients (e.g., menthol, to cool the skin, or thermal agents to heal the skin after nicks or cuts), or even one or more razor blades. For instance, in a razor cartridge arranged with one or more shaving aid holders or wings having undercut elements as described in the present invention, it is envisioned that, with a slight turn of the hand or wrist, the user may easily flip to access the back side of the razor and thus, the other side of the shaving aid element. As depicted in FIG. 18, a top view of the back side of a razor system 1800 is shown with an exfoliation member 1820 covering the lower outer surface of the shaving aid holder 1810 (covered by the exfoliation member 1820), usable by the consumer by turning the razor to this opposing side.

Besides allowing for extra aesthetic or functional benefits over the prior art, other additional benefits of having a "one-sided" shaving aid element as described herein may be that the costs for tooling and ingredients for the shaving aid portion may desirably be reduced.

Figure 19:
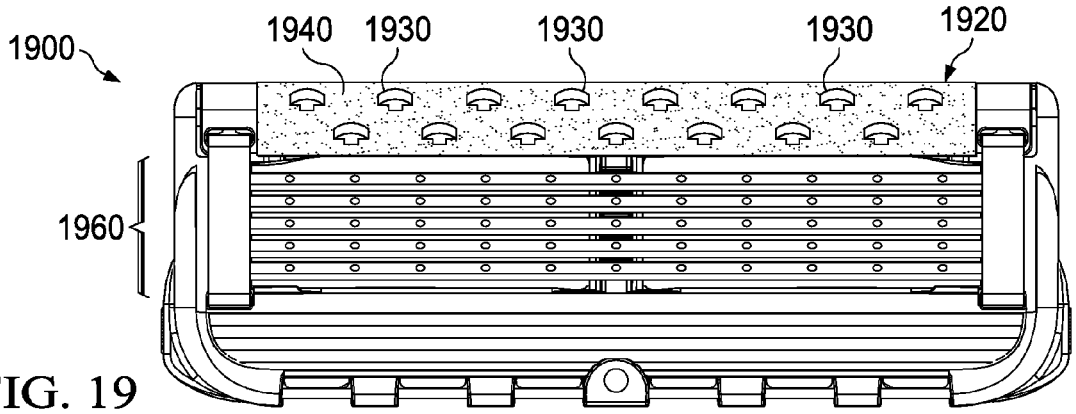
FIG. 19 depicts a top view of a razor cartridge having a shaving aid element where the shaving aid holder is part of a razor cartridge component in accordance with the present invention.

Referring now to FIG. 19, a shaving aid holder 1920 of the present invention having one or more undercut elements 1930 of mushroom shape with a curved smooth upper surface, is shown as being formed as part of a cap or a cap structure component of a razor cartridge 1900 (e.g., to the rear of, and proximal to, the blades). In this way, shaving aid portion 1940 disposed on the shaving aid holder 1920 and covering undercut elements 1930 may provide skin benefits and enhance a user's shave as the shaving aid portion is disposed closer to the blade unit 1960. Though depicted as being mushroom-shaped, the undercut elements disposed on a cartridge as described in FIG. 19 or elsewhere on any component of a cartridge, may be of any shape feasibly contemplated in the present invention.

Other applications of the present invention may extend to personal care products. For instance, many deodorant or anti perspirant products include a "stick" coupled to a plastic mount. Albeit not for shaving, the stick portion of a deodorant can be likened to the shaving aid portion of the present invention and the mount to the shaving aid holder. As such, the tenets of the present invention may be easily transferable outside of the razor cartridge area.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor cartridge comprising:

at least one shaving aid holder having two or more undercut elements defining two or more undercut areas, wherein said two or more undercut elements further comprise one or more protrusions protruding from an upper surface of said shaving aid holder and one or more cavities recessed and extending within said upper surface of said shaving aid holder towards a lower surface, said one or more cavities having a curved contour in a cross-section; and at least one shaving aid portion covering said two or more undercut elements and occupying said two or more undercut areas.

2. The cartridge of claim 1 wherein any one of said two or more undercut elements further comprise a curved hook structure, a mushroom shape structure, a straight-line structure, an angled structure, or any combination thereof.

3. The cartridge of claim 1 wherein said two or more undercut elements provide an interlocking mechanism for retaining said at least one shaving aid portion to said at least one shaving aid holder.

4. The cartridge of claim 3 wherein said interlocking mechanism further comprises an interlock area of the shaving aid portion and an interlock area of the shaving aid holder.

5. The cartridge of claim 1 wherein any one of said one or more undercut elements are rigid, flexible, semi-rigid, or any combination thereof.

6. The cartridge of claim 1 wherein any one of said one or more undercut elements are comprised of plastic, metal, a composite, or any combination thereof.

7. The cartridge of claim 1 wherein any one of said one or more undercut elements has a curved upper surface.

8. The cartridge of claim 7 wherein said curved undercut element curves towards an upper surface of said shaving aid holder.

9. The cartridge of claim 1 wherein any one of said one or more undercut elements has a height or depth ranging from 0.2 mm to 2.5 mm.

10. The cartridge of claim 5 wherein said at least one shaving aid portion is comprised of poured, pressed, or extruded soap, gel, lubricant, moisturizer, or any combination thereof.

11. The cartridge of claim 1 wherein said shaving aid holder is comprised of a polymeric material, an elastomeric material, or any combination thereof.

12. The cartridge of claim 11 wherein said shaving aid holder is formed as a wing, a ring, a part of a frame, cap, guard, clip, or mount structure coupled to said razor cartridge, or any combination thereof.

13. The cartridge of claim 1 wherein said at least one shaving aid holder has no apertures.

14. The cartridge of claim 1 wherein said at least one shaving aid holder has one or more apertures.

15. The cartridge of claim 1 wherein said shaving aid portion is not disposed on a lower surface of said shaving aid holder.

16. The cartridge of claim 15 wherein at least one aesthetic element, at least one functional element, or any combination thereof may be disposed on a lower surface of said at least one shaving aid holder.

17. The cartridge of claim 16 wherein said at least one aesthetic element further comprises indicia, marking, design, graphic, text, or any combination thereof.

18. The cartridge of claim 16 wherein said at least one functional element further comprises exfoliation, skin conditioning, moisturization elements, or any combination thereof.

19. The razor cartridge of claim 1 wherein said shaving aid holder is hinged to a frame of said razor cartridge.

20. A shaving aid element comprising:

at least one shaving aid holder having two or more undercut elements incorporated onto an upper surface of said at least one shaving aid holder, wherein said two or more undercut elements define two or more undercut areas, wherein said one or more undercut elements further comprise one or more protrusions protruding from said upper surface of said shaving aid holder and one or more cavities recessed and extending within said upper surface of said shaving aid holder towards a lower surface, said one or more cavities having a curved contour in a cross-section; and at least one shaving aid portion disposed on said upper surface of said at least one shaving aid holder covering said two or more undercut elements and occupying said two or more undercut areas.

21. The shaving aid element of claim 20 wherein said two or more undercut elements provide an interlocking mechanism for retaining said at least one shaving aid portion to said at least one shaving aid holder.

22. The shaving aid element of claim 21 wherein said interlocking mechanism comprises an interlock area of said at least one shaving aid portion and an interlock area of said at least one shaving aid holder.

23. The shaving aid of claim 20 wherein at least one of said one or more protrusions has a curved upper surface.

24. The cartridge of claim 23 wherein said curved protrusion curves towards an upper surface of said shaving aid holder.

* * * * *